US010227705B2

(12) United States Patent
Wang et al.

(10) Patent No.: US 10,227,705 B2
(45) Date of Patent: Mar. 12, 2019

(54) APPARATUS AND METHOD FOR PLATING AND/OR POLISHING WAFER

(71) Applicant: ACM Research (Shanghai) Inc., Shanghai (CN)

(72) Inventors: Jian Wang, Shanghai (CN); Yinuo Jin, Shanghai (CN); Hongchao Yang, Shanghai (CN); Hui Wang, Shanghai (CN)

(73) Assignee: ACM Research (Shanghai) Inc., Shanghai (CN)

( * ) Notice: Subject to any disclaimer, the term of this patent is extended or adjusted under 35 U.S.C. 154(b) by 477 days.

(21) Appl. No.: 14/889,922

(22) PCT Filed: May 9, 2013

(86) PCT No.: PCT/CN2013/075410
§ 371 (c)(1),
(2) Date: Nov. 9, 2015

(87) PCT Pub. No.: WO2014/179968
PCT Pub. Date: Nov. 13, 2014

(65) Prior Publication Data

US 2016/0115613 A1 Apr. 28, 2016

(51) Int. Cl.
*C25F 7/00* (2006.01)
*C25D 7/12* (2006.01)
(Continued)

(52) U.S. Cl.
CPC ..... *C25D 7/12* (2013.01); *B24B 37/046* (2013.01); *B24B 57/02* (2013.01); *C25D 17/001* (2013.01);
(Continued)

(58) Field of Classification Search
None
See application file for complete search history.

(56) References Cited

U.S. PATENT DOCUMENTS 6,527,920 B1 * 3/2003 Mayer ..... C25D 21/12 204/237
2003/0141201 A1 * 7/2003 Basol ..... C25F 3/14 205/668
(Continued)

FOREIGN PATENT DOCUMENTS

CN 1346510 A 4/2002
CN 1636267 A 7/2005
(Continued)

OTHER PUBLICATIONS

Office Action issued in Chinese Application No. 201380076475.2; dated Jan. 25, 2017 (6 pages).
(Continued)

*Primary Examiner* — Stefanie S Wittenberg
(74) *Attorney, Agent, or Firm* — Osha Liang LLP

(57) ABSTRACT

An apparatus and a method for plating and/or polishing wafer includes a wafer chuck, an auxiliary nozzle apparatus and a main nozzle apparatus. The wafer chuck holds and positions the wafer, moves horizontally, and rotates. The auxiliary nozzle apparatus supplies uncharged or charged electrolyte to cover the outer edge of the wafer and the wafer chuck, and the main nozzle apparatus supplies charged electrolyte to the surface of the wafer, to improve the plating and/or polishing uniformity of the outer edge of the wafer, reduce the entire electric resistance of the apparatus, and improve the plating and/or polishing rate.

21 Claims, 20 Drawing Sheets

(51) Int. Cl.

| | |
|---|---|
| ***B24B 37/04*** | (2012.01) |
| ***B24B 57/02*** | (2006.01) |
| ***C25D 17/00*** | (2006.01) |
| ***C25D 17/06*** | (2006.01) |
| ***C25F 3/30*** | (2006.01) |

(52) U.S. Cl.
CPC ..... *C25D 17/005* (2013.01); *C25D 17/06* (2013.01); *C25F 3/30* (2013.01); *C25F 7/00* (2013.01)

(56) References Cited

U.S. PATENT DOCUMENTS

2004/0238481 A1* 12/2004 Wang ..... B23H 3/00 216/2
2007/0131561 A1 6/2007 Wang et al.
2007/0246350 A1* 10/2007 Togashi ..... C25D 5/08 204/237
2008/0173333 A1 7/2008 Nanba et al.
2015/0159276 A1* 6/2015 Kaneko ..... C23C 18/1675 427/261

FOREIGN PATENT DOCUMENTS

| | | | | |
|---|---|---|---|---|
| CN | 101090063 | A | 12/2007 | |
| CN | 100497748 | C | 6/2009 | |
| JP | 6-310418 | A | 11/1994 | |
| JP | 2015034349 | * | 2/2015 | ..... C23C 18/31 |

OTHER PUBLICATIONS

Office Action issued in Japanese Patent Application No. 2016-512187; dated Feb. 28, 2017, with translation (6 pages).
International Search Report in corresponding application No. PCT/CN2013/075410 dated Feb. 20, 2014 (1 page).

* cited by examiner

APPARATUS AND METHOD FOR PLATING AND/OR POLISHING WAFER

CROSS REFERENCE TO RELATED APPLICATIONS

This is a national stage application of PCT/CN2013/075410, filed on May 9, 2013, the disclosure of which is incorporated by reference in its entirety.

BACKGROUND OF THE INVENTION

1. Field of the Invention

The present invention generally relates to the field of fabricating integrated circuits, and more particularly relates to an apparatus and method for plating and/or polishing metal layers on semiconductor wafers.

2. The Related Art

Integrated circuits are widely applied in electronic industry. The integrated circuits are manufactured or fabricated on semiconductor material usually called semiconductor wafers. For forming electronic circuitry of the integrated circuits, the wafers may undergo such as multiple masking, etching, plating and polishing processes, and so on.

With the rapid development of the electronic industry, the demand on minisize, low power consumption and high reliability becomes inevitable to electronic products. Correspondingly, the integrated circuits which are as the key components of the electronic products must be improved for meeting the demand of the electronic products. In order to increase the power of the integrated circuits, one method is to decrease the feature size of the integrated circuits. In fact, the feature size of the integrated circuits has been quickly decreased from 90 nanometers to 65 nanometers, and now to 25 nanometers. Undoubtedly, the feature size of the integrated circuits will be further decreased with the improvement of the semiconductor technology.

However, one potential limiting factor to develop more powerful integrated circuits is the increasing signal delays at interconnections formed in the integrated circuits. As the feature size of the integrated circuits has decreased, the density of interconnections formed in the integrated circuits has increased. However, the closer proximity of interconnections increases the line-to-line capacitance of the interconnections, which results in greater signal delay at the interconnections. Generally, interconnection delays have been found to increase with the square of the reduction in feature size. In contrast, gate delays have been found to increase linearly with the reduction in feature size.

One conventional approach to compensate for this increase in the interconnection delay is to add more layers of metal. However, this approach has the disadvantages of increasing production costs associated with forming the additional layers of metal. Furthermore, these additional layers of metal can generate additional heat, which can be adverse to both chip performance and reliability.

Consequently, copper instead of aluminum has been widely used in the semiconductor industry to form the metal interconnections for copper has greater conductivity than aluminum. Also, copper is less resistant to electromigration than aluminum. However, before copper can be widely used by the semiconductor industry, new processing techniques are required. More particularly, a copper layer may be formed on a wafer using an electroplating process and/or etched using an electropolishing process. In the electroplating and/or electropolishing process, the wafer is held by a wafer chuck and an electrolyte solution is then applied on the wafer by a nozzle. A conventional electroplating and/or electropolishing apparatus has a nozzle with small size for ensuring the electroplating and/or electropolishing uniformity, which plating rate and/or removal rate is low. For improving the plating rate and/or removal rate, if only increase the size of the nozzle, the electroplating and/or electropolishing uniformity of the outer edge of the wafer will become worse. How to improve the plating rate and/or removal rate and at the same time ensure the electroplating and/or electropolishing uniformity of the outer edge of the wafer during the electroplating and/or electropolishing process is a challenge which needs to overcome.

SUMMARY

Accordingly, an object of the present invention is to provide an apparatus for plating and/or polishing wafer. In an embodiment, the apparatus includes a wafer chuck, an auxiliary nozzle apparatus and a main nozzle apparatus. The wafer chuck capable of moving horizontally and rotating is used for holding and positioning a wafer. The wafer chuck has an electrode, a metal ring encircling the outer edge of the wafer and an insulated ring disposed between the electrode and the metal ring. The auxiliary nozzle apparatus has a supplying pipe. The supplying pipe defines several nozzles for supplying electrolyte to cover the area from the outer edge of the wafer to the electrode of the wafer chuck. The main nozzle apparatus has a conductive body and an insulated nozzle head. The conductive body has a fixing portion and a receiving portion. The insulated nozzle head has a cover and a tube. The tube is received in the receiving portion and passes through the receiving portion for supplying electrolyte to the surface of the wafer. A first gap is formed between an inner circumferential surface of the receiving portion and an outer circumferential surface of the tube. The cover is disposed above the fixing portion and a second gap is formed between the cover and the fixing portion.

In another embodiment, the supplying pipe of the auxiliary nozzle apparatus is made of conductive metal and is used as a secondary electrode.

In another embodiment, the apparatus includes a wafer chuck, an auxiliary nozzle apparatus and a main nozzle apparatus. The wafer chuck capable of moving horizontally and rotating is used for holding and positioning a wafer. The auxiliary nozzle apparatus has a supplying pipe made of conductive metal and being used as an electrode. The supplying pipe defines several nozzles for supplying electrolyte to cover the outer edge of the wafer.

In another embodiment, the apparatus includes a wafer chuck, a main chamber, an auxiliary chamber, an auxiliary nozzle apparatus, a main nozzle apparatus and a shroud. The shroud includes a circle portion and a rectangle portion. The circle portion is disposed in the main chamber and encircles the main nozzle apparatus. The rectangle portion is disposed in the auxiliary chamber and shields the auxiliary nozzle apparatus. The rectangle portion defines an eject window from where electrolyte is ejected to cover the area from the outer edge of the wafer to the electrode of the wafer chuck.

In another embodiment, a conductive metal wraps the eject window. The conductive metal is used as a secondary electrode for charging the electrolyte when the electrolyte is ejected from the eject window.

In another embodiment, the apparatus includes a wafer chuck, a main chamber, an auxiliary chamber, an auxiliary nozzle apparatus, a main nozzle apparatus and a shroud. The wafer chuck capable of moving horizontally and rotating is used for holding and positioning a wafer. The shroud includes a circle portion and a rectangle portion. The circle portion is disposed in the main chamber and encircles the main nozzle apparatus. The rectangle portion is disposed in the auxiliary chamber and shields the auxiliary nozzle apparatus. The rectangle portion defines an eject window from where electrolyte is ejected to cover the outer edge of the wafer. The eject window is wrapped by a conductive metal which is used as an electrode.

Accordingly, another object of the present invention is to provide a method for plating and/or polishing wafer. The method includes the steps: positioning a wafer on a wafer chuck; horizontally moving and rotating the wafer chuck; and supplying charged electrolyte to the surface of the wafer, and at the same time supplying uncharged or charged electrolyte to cover the outer edge of the wafer and the wafer chuck for forming a breakover between the outer edge of the wafer and a power supply.

As described above, through supplying the uncharged or charged electrolyte to cover the outer edge of the wafer and the wafer chuck for forming a breakover between the outer edge of the wafer and the power supply all the time during the whole plating and/or polishing process, the outer edge of the wafer and the power supply can form a stable electric connection, which can improve the plating and/or polishing uniformity of the outer edge of the wafer and reduce the entire electric resistance of the apparatus. Moreover, the ejecting port of the main nozzle apparatus is relatively large to improve the plating and/or polishing rate.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF EMBODIMENTS

Figure 1:
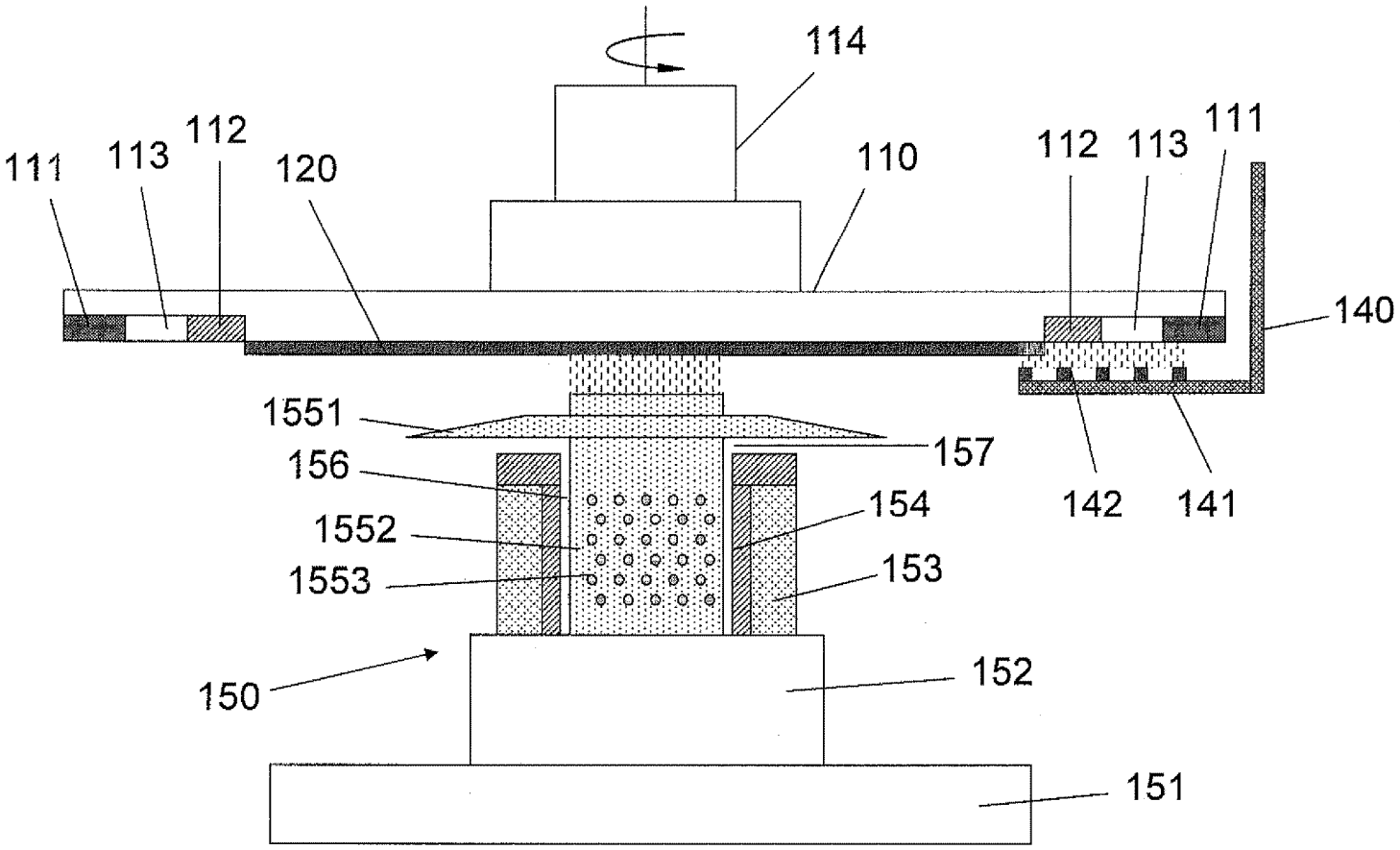
FIG. 1 is a schematic view showing an exemplary apparatus for plating and/or polishing wafer according to the present invention.

Referring to FIG. 1 to FIG. 5, an exemplary apparatus for plating and/or polishing wafer according to the present invention is illustrated. The apparatus plates and/or polishes the wafer based on electrochemical principle. The exemplary apparatus of the present invention includes a wafer chuck 110 for holding and positioning a wafer 120 thereon. The wafer chuck 110 can be a vacuum chuck which can hold and position the wafer 120 by vacuum suction. The wafer chuck 110 has an electrode 111. Preferably, the electrode 111 is ringlike and encircles the wafer 120. During the plating process, the electrode 111 is connected to the cathode of a power supply (not shown), and during the polishing process, the electrode 111 is connected to the anode of the power supply. The electrode 111 and the wafer 120 can form an electric connection through electrolyte. Through the electrode 111 and the electrolyte, a breakover is formed between the wafer 120 and the power supply, which will be described detailed hereinafter.

Generally, in the plating process or the polishing process, metal, particularly, copper is easy to accumulate on the outer edge of the wafer 120, causing the wafer 120 to be plated and/or polished not evenly, especially the uniformity of the outer edge of the wafer 120 is bad. For solving the problem, the wafer chuck 110 of the present invention has a metal ring 112 disposed around the outer edge of the wafer 120. Between the electrode 111 and the metal ring 112, an insulated ring 113 is disposed to separate the electrode 111 and the metal ring 112 from each other, preventing the electrode 111 and the metal ring 112 from breakover. The diameter of the electrode 111 is greater than the metal ring 112 so the electrode 111 encircles the insulated ring 113 and the metal ring 112.

Figure 2:
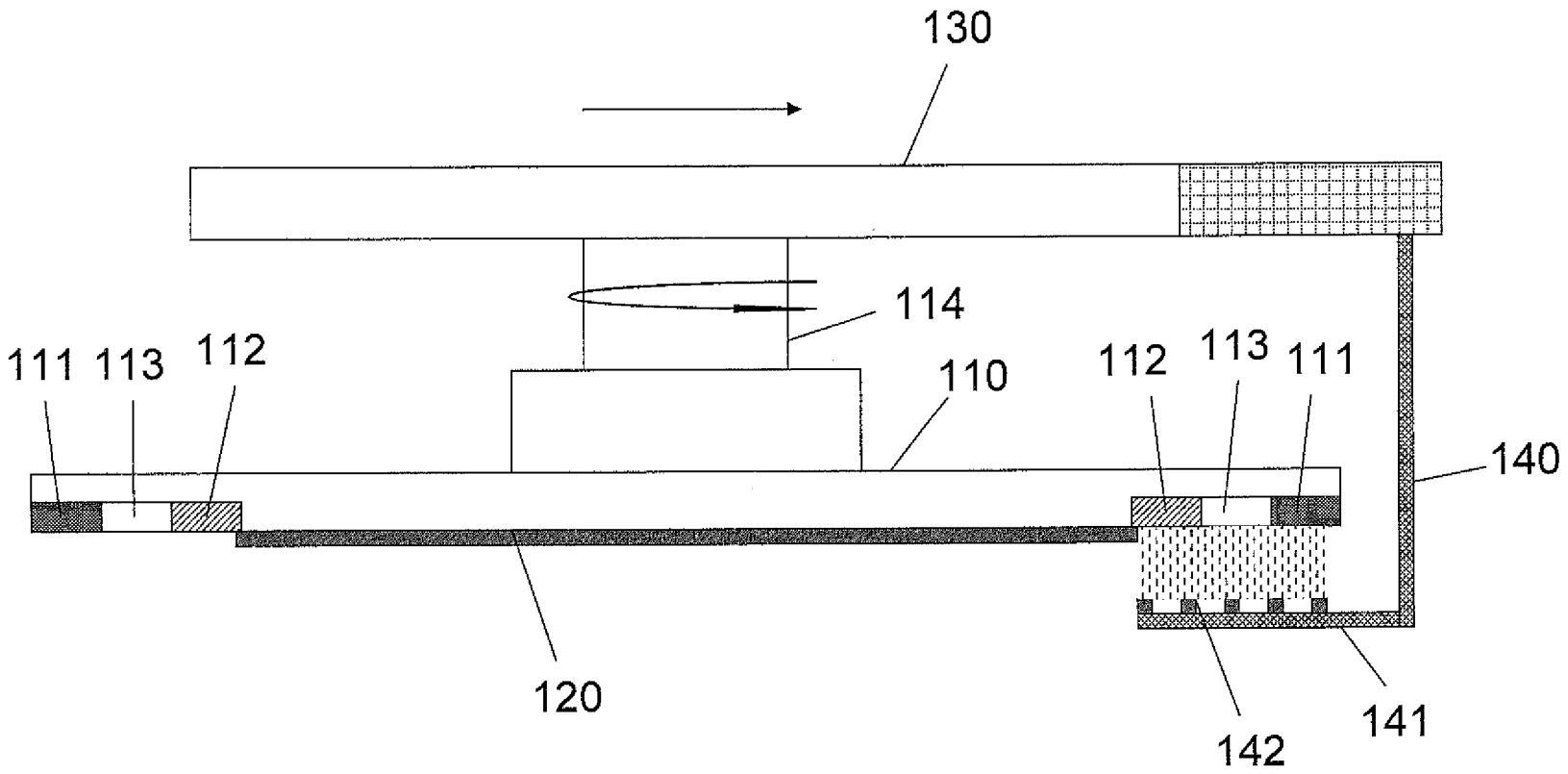
FIG. 2 is a schematic view showing a wafer chuck and an auxiliary nozzle apparatus which is in working status.

The wafer chuck 110 has a rotating shaft 114 disposed at the top portion thereof. The rotating shaft 114 can rotate about an axis through its center and then bring the wafer chuck 110 to rotate about its center axis. The rotating shaft 114 can be installed on a beam 130 above the wafer chuck 110, as shown in FIG. 2. The beam 130 can move horizontally, which can bring the wafer chuck 110 to move horizontally.

Figure 3:
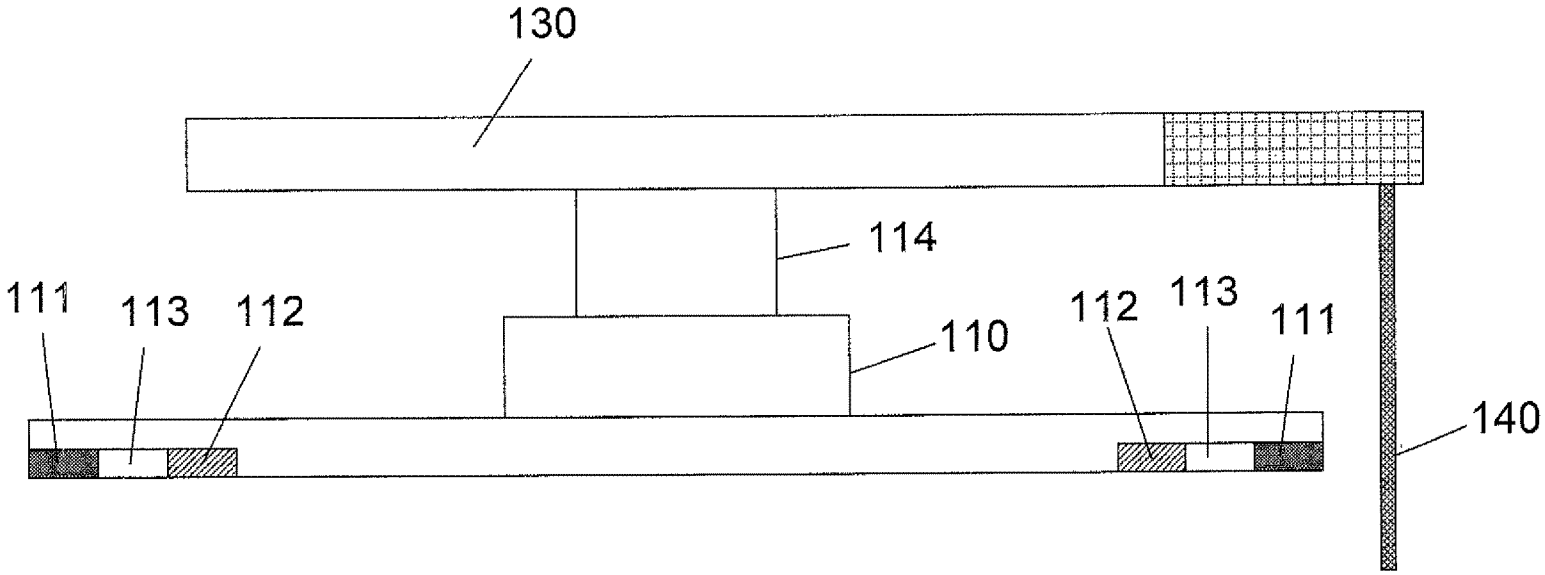
FIG. 3 is a schematic view showing the wafer chuck and the auxiliary nozzle apparatus which is in idle status.
Figure 4:
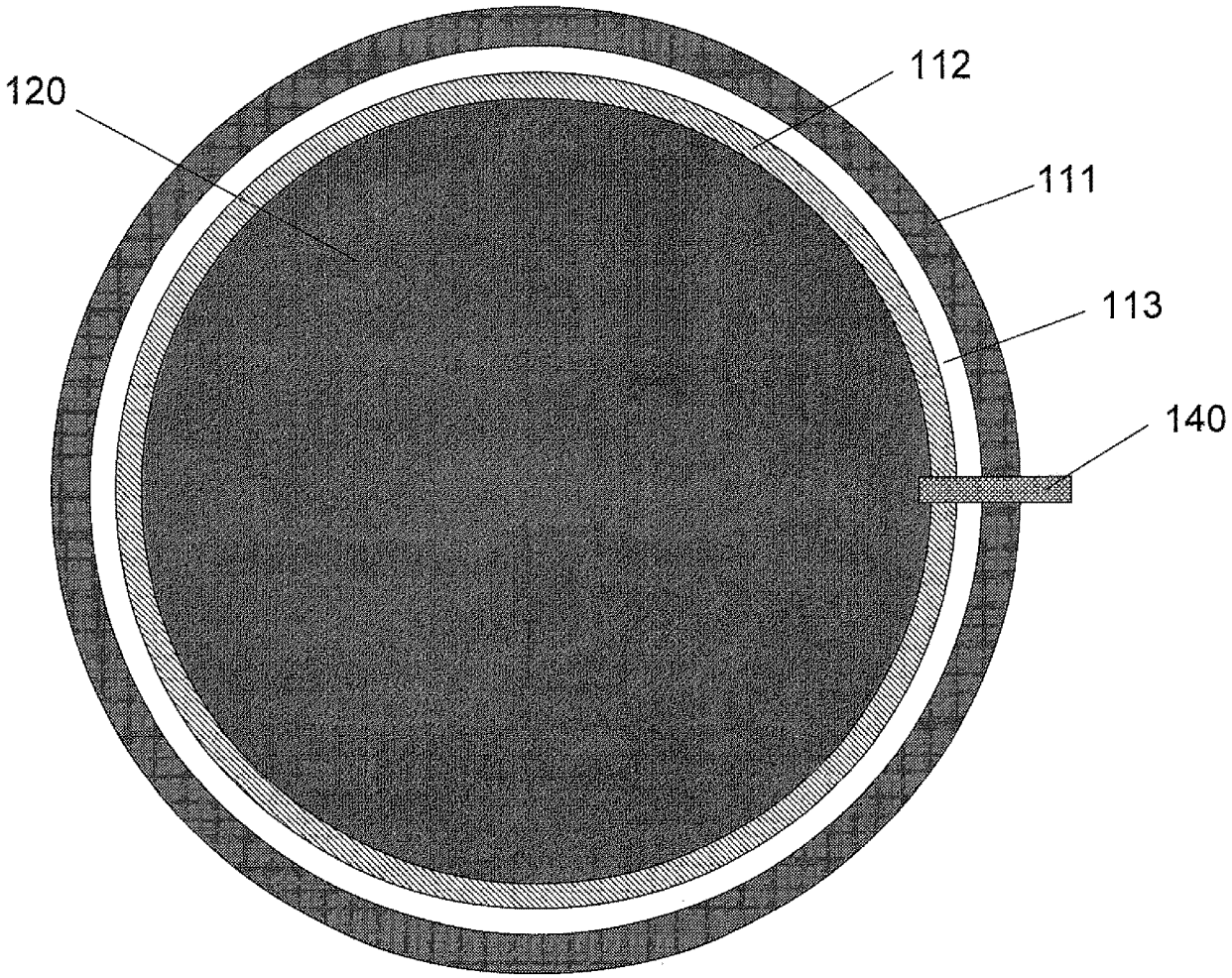
FIG. 4 is a bottom view showing the wafer chuck and the auxiliary nozzle apparatus which is in working status.
Figure 5:
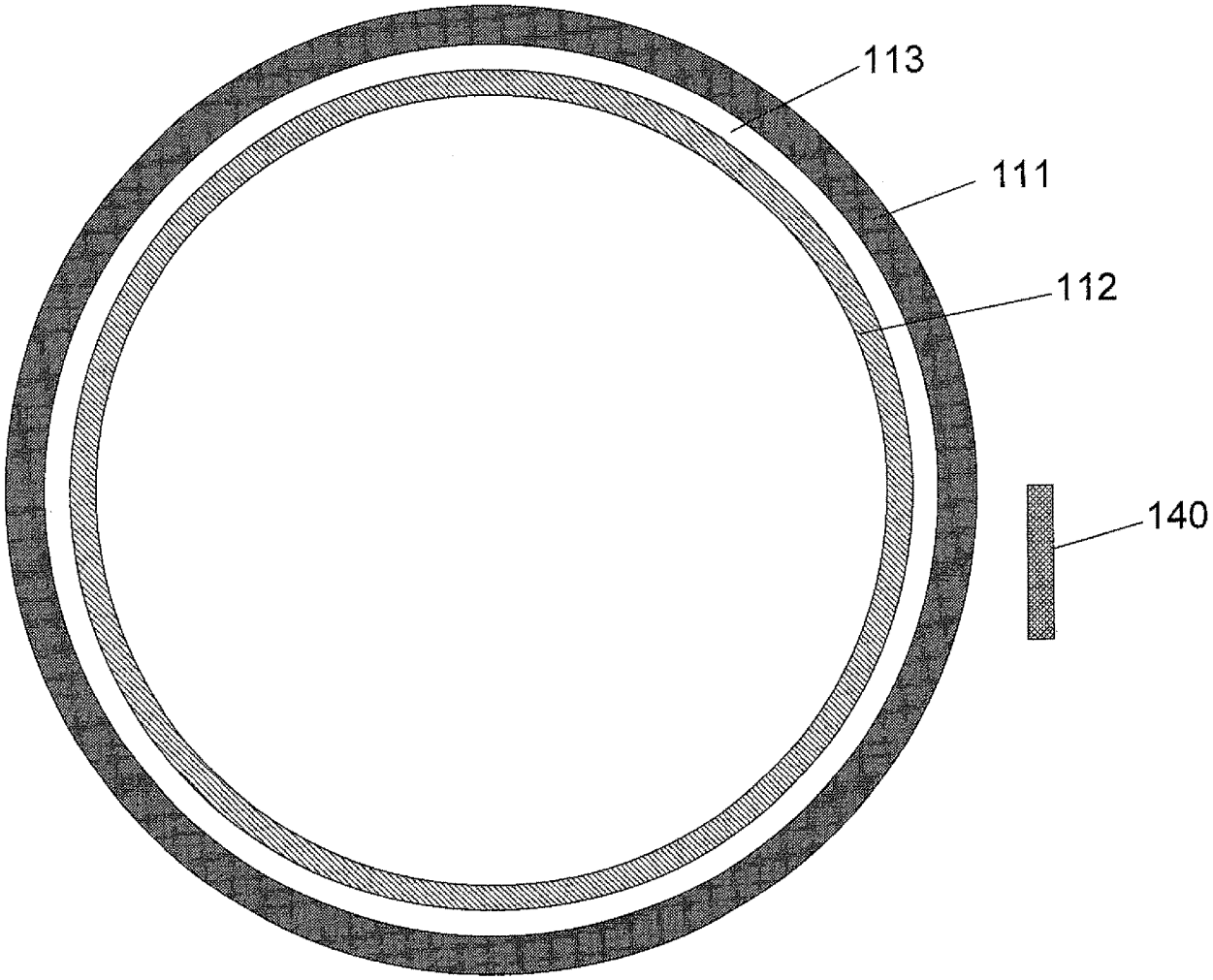
FIG. 5 is a bottom view showing the wafer chuck and the auxiliary nozzle apparatus which is in idle status.
Figure 6:
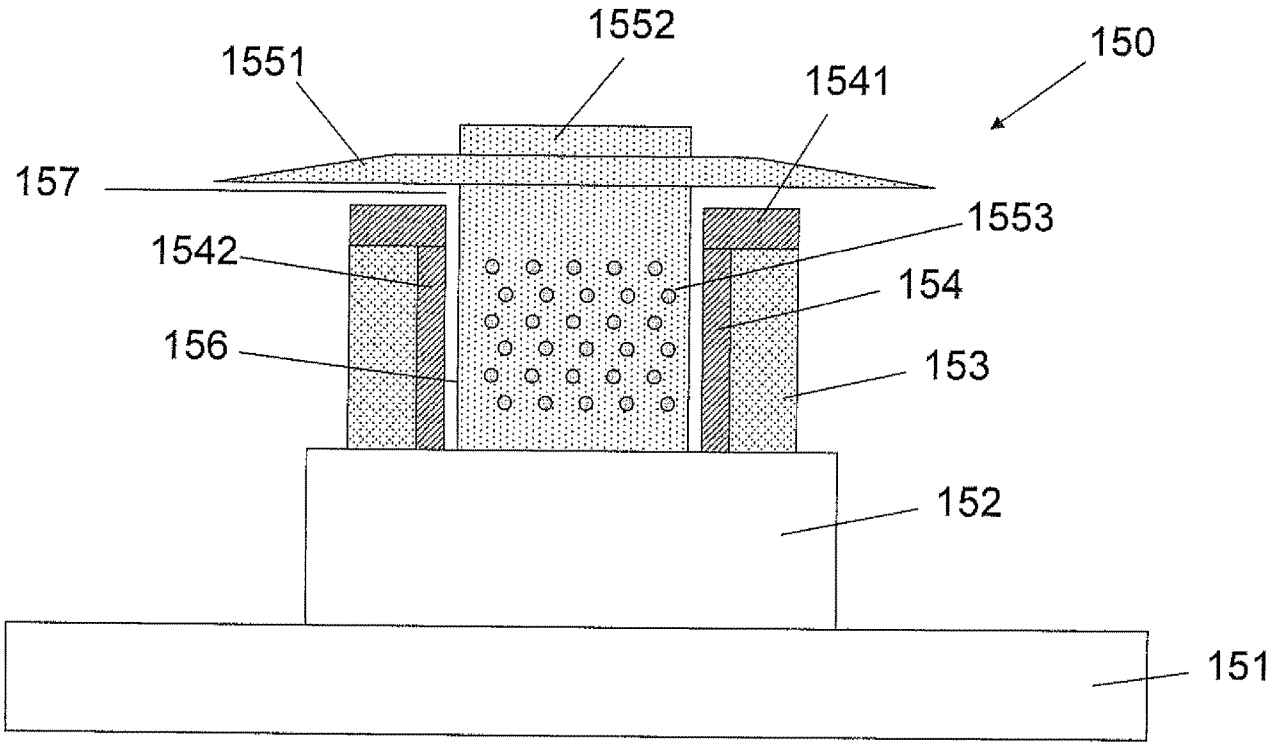
FIG. 6 is a schematic view showing an exemplary main nozzle apparatus of the present invention.
Figure 7:
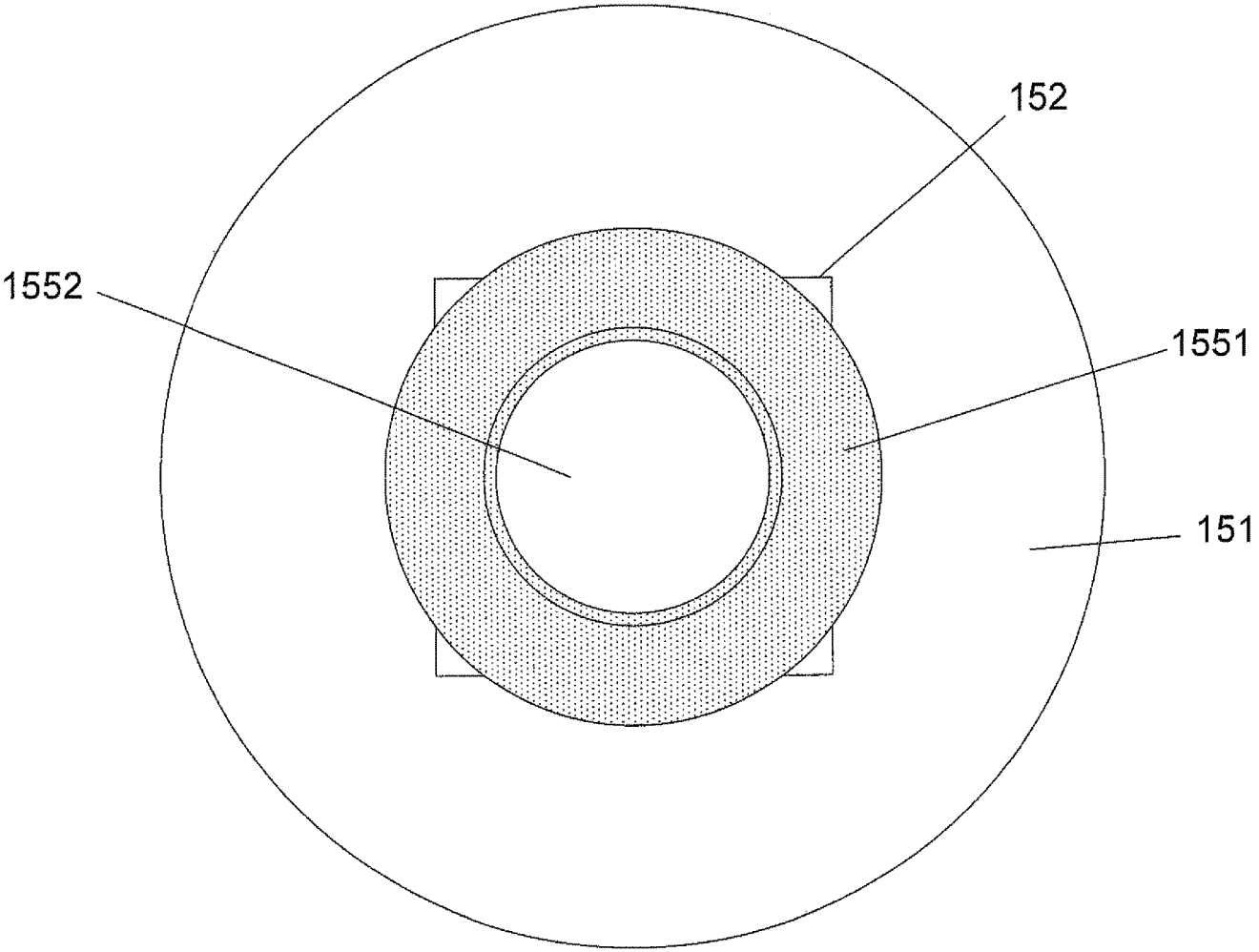
FIG. 7 is a top view of the main nozzle apparatus.
Figure 8:
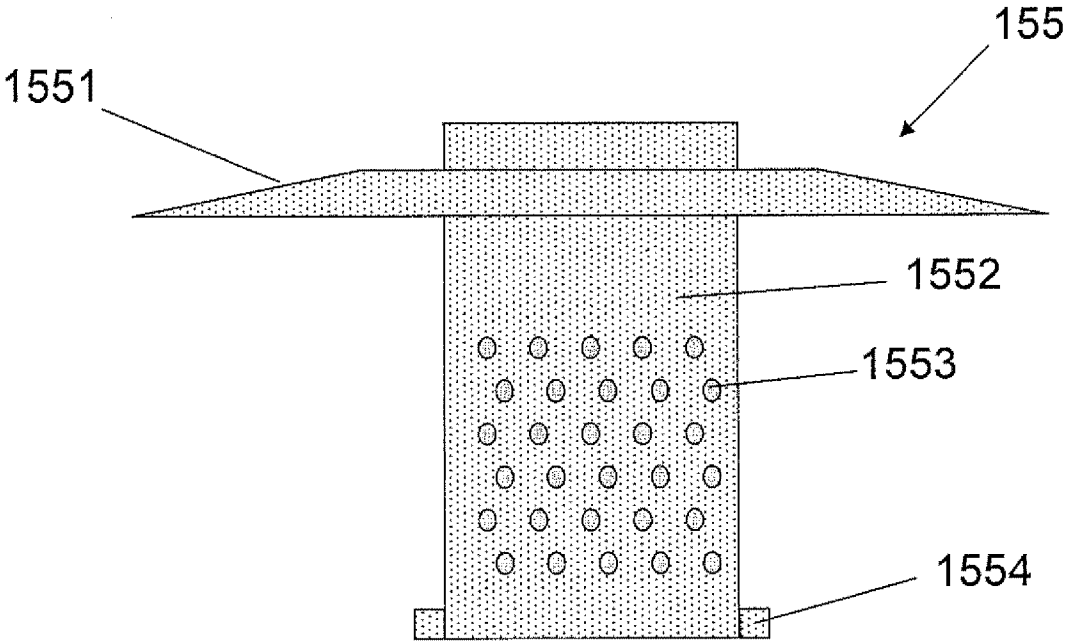
FIG. 8 is a schematic view showing an exemplary nozzle head of the main nozzle apparatus.
Figure 10:
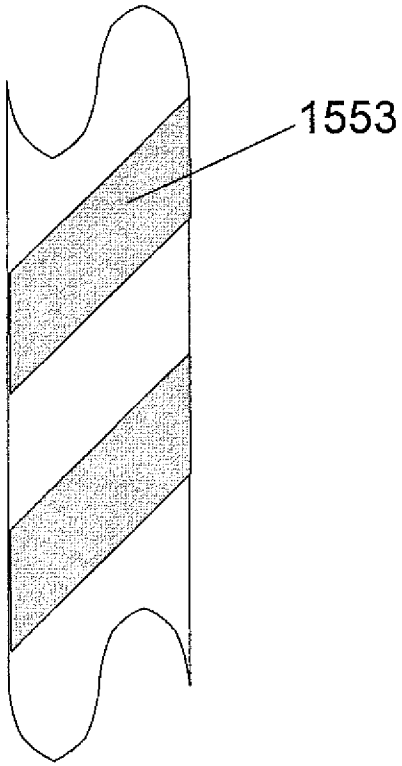
FIG. 10 is an enlarged view of A portion shown in FIG. 9.
Figure 9:
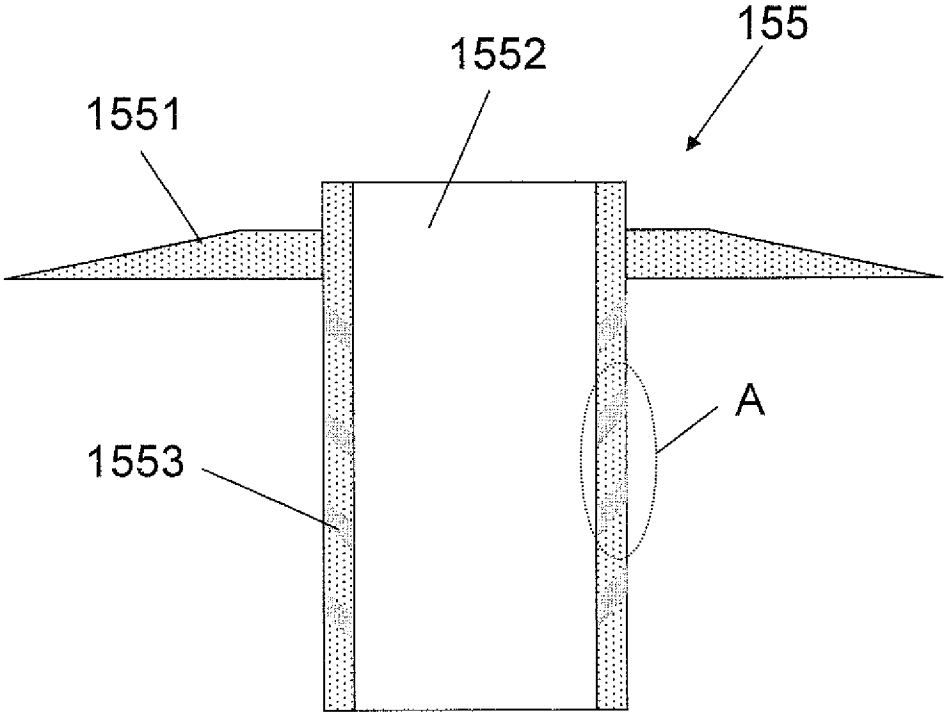
FIG. 9 is a cross-sectional view of the nozzle head.

In the plating process or the polishing process, the wafer chuck 110 can move horizontally along with the beam 130 and rotate about its center axis. The electrolyte supplied on the wafer 120 can form an electrolyte film coating the surfaces of the wafer 120 and the wafer chuck 110 for the rotation of the wafer chuck 110. Therefore, the electrode 111 of the wafer chuck 110 and the wafer 120 form an electric connection therebetween through the electrolyte film and the electric current mainly flows past from the surface of the wafer 120, and then the wafer 120 is plated or polished. However, in the actual application, when plating or polishing the outer edge of the wafer 120, the electrolyte may be spun off from the surface of the wafer 120 directly and can't form the electrolyte film on the surfaces of the wafer 120 and the wafer chuck 110. The electric connection between the electrode 111 and the wafer 120 is open from time to time, causing the outer edge of the wafer 120 to be plated or polished not evenly. In order to improve the plating or polishing uniformity of the outer edge of the wafer 120, the present invention provides an auxiliary nozzle apparatus 140. In the embodiment, the auxiliary nozzle apparatus 140 is assembled on the beam 130. The auxiliary nozzle apparatus 140 can move horizontally along with the beam 130 and keep a constant interval with the outer edge of the wafer chuck 110, avoiding interfering the rotation of the wafer chuck 110. The auxiliary nozzle apparatus 140 has a supplying pipe 141. The supplying pipe 141 defines several small nozzles 142 arranged in a row for supplying the electrolyte to the outer edge of the wafer 120 and the wafer chuck 110. The area from the outer edge of the wafer 120 to the electrode 111 can be covered by the electrolyte while plating or polishing. The supplying pipe 141 can be connected with an independent plumbing system, so the flow of the electrolyte in the supplying pipe 141 can be controlled independently. The auxiliary nozzle apparatus 140 is rotatable in horizontal plane by a motor or a cylinder. Particularly, when the wafer 120 is plated or polished, the auxiliary nozzle apparatus 140 rotates 90 degrees and the supplying pipe 141 is parallel with the horizontal movement direction of the wafer 120. The supplying pipe 141 is below the wafer chuck 110 and the nozzles 142 are over against the outer edge of the wafer 120 and the wafer chuck 110, as shown in FIG. 1, FIG. 2 and FIG. 4. After the wafer 120 is plated or polished, the auxiliary nozzle apparatus 140 can reverse 90 degrees and the supplying pipe 141 is perpendicular to the horizontal movement direction of the wafer 120, and there is no electrolyte supplied to the outer edge of the wafer 120 and the wafer chuck 110, as shown in FIG. 3 and FIG. 5.

Referring to FIG. 6 to FIG. 10, for plating or polishing, a main nozzle apparatus 150 is disposed below the wafer chuck 110 for supplying charged electrolyte to the surface of the wafer 120. The main nozzle apparatus 150 has a base portion 151 through which the main nozzle apparatus 150 can be fixed in a plating or polishing chamber. A connecting portion 152 is located on the top of the base portion 151. A cylinder-shaped hollow holding portion 153 is located on the top of the connecting portion 152. The base portion 151, the connecting portion 152 and the holding portion 153 are insulated and can resist erosion of the electrolyte and cannot react with the electrolyte. The holding portion 153 holds and receives a conductive body 154 which is made of good conductive material and can resist erosion of the electrolyte and cannot react with the electrolyte, such as stainless steel or aluminum alloy, etc. The conductive body 154 has a fixing portion 1541 fixed on the top of the holding portion 153 and a cylinder-shaped hollow receiving portion 1542 connected with the fixing portion 1541 and received in the holding portion 153. During the plating process, the conductive body 154 is connected to the anode of the power supply, and during the polishing process, the conductive body 154 is connected to the cathode of the power supply.

The main nozzle apparatus 150 has an insulated nozzle head 155. The insulated nozzle head 155 has a disk-shaped cover 1551 and a tube 1552 extending vertically through the center of the cover 1551. The top port of the tube 1552 is defined as an ejecting port from where the electrolyte is ejected on the surface of the wafer 120. The ejecting port of the tube 1552 is circular. Based on different requirements of the plating or polishing process, the shape of the ejecting port can be changed and designed not only into circle, but also triangle or square or sexangle or octagon, etc. The tube 1552 is received in the conductive body 154 and passes through the conductive body 154. A first gap 156 is formed between an inner circumferential surface of the receiving portion 1542 of the conductive body 154 and an outer circumferential surface of the tube 1552. The cover 1551 is disposed above the fixing portion 1541 of the conductive body 154 and a second gap 157 is formed therebetween. The side wall of the tube 1552 defines a plurality of passages 1553. Every passage 1553 is inclined and the highest point of the internal port of the passage 1553 is lower than the lowest point of the external port of the passage 1553. Based on the special design of the passage 1553 and adjusting the electrolyte pressure in the tube 1552 and the first gap 156, the electrolyte can only pass through the passages 1553 from the tube 1552 to the first gap 156 and cannot pass through the passages 1553 from the first gap 156 to the tube 1552, which can reduce the electric resistance of the apparatus and prevent micro bubbles from entering the tube 1552 from the first gap 156 while plating or polishing. The flow of the electrolyte in the first gap 156 can be adjusted by a flow adjust ring 1554 which is disposed at the lower end of the tube 1552 and attached around the outer circumferential surface of the tube 1552, so that the electrolyte pressure in the first gap 156 is adjusted. The flow adjust ring 1554 can be replaced for choosing the flow adjust ring 1554 with required size. The second gap 157 can be adjusted by raising or lowering the insulated nozzle head 155.

When plating and/or polishing, the wafer 120 is positioned on the wafer chuck 110 and the surface of the wafer 120 to be plated and/or polished faces to the main nozzle apparatus 150. The auxiliary nozzle apparatus 140 rotates 90 degrees and the supplying pipe 141 is below the wafer chuck 110 and the nozzles 142 are over against the outer edge of the wafer 120 and the wafer chuck 110. The beam 130 brings the wafer chuck 110 and the auxiliary nozzle apparatus 140 to move horizontally and at the same time the wafer chuck 110 rotates while the auxiliary nozzle apparatus 140 and the main nozzle apparatus 150 respectively supply the electrolyte to the surface of the wafer 120. The auxiliary nozzle apparatus 140 supplies the electrolyte to the outer edge of the wafer 120 and the wafer chuck 110 through the nozzles 142. The electrolyte covers the area from the outer edge of the wafer 120 to the electrode 111 of the wafer chuck 110 all the time during the whole plating and/or polishing process, so the electric connection between the wafer 120 and the power supply is stable. The main nozzle apparatus 150 supplies the electrolyte to the surface of the wafer 120 through the tube 1552. The micro bubbles generated on the inner circumferential surface of the receiving portion 1542 of the conductive body 154 are crowded out of the main nozzle apparatus 150 through the first gap 156 along with the electrolyte. The electrolyte flowing through the first gap 156 is blocked by the cover 1551 of the insulated nozzle head 155 and cannot reach to the surface of the wafer 120. Because of the passages 1553 defined on the side wall of the tube 1552, the micro bubbles cannot enter the tube 1552, which can improve the quality of the plating and/or polishing. Through the electrolyte, the conductive body 154, the wafer 120, the electrode 111 and the power supply constitute a circuit and the electric current mainly flows past from the surface of the wafer 120 to plate and/or polish the surface of the wafer 120. For improving the plating and/or polishing rate, the internal diameter of the tube 1552 is relatively large and is in proportion to the width of the insulated ring 113 or the metal ring 112 for preventing the main nozzle apparatus 150 from supplying the electrolyte to the electrode 111, which can reduce the electric resistance of the apparatus and ensure that the electric current flows through the surface of the wafer 120. Preferably, the internal diameter of the tube 1552 is in the range of 0.5 to 1.5 times of the width of the insulated ring 113 or the metal ring 112. The flow of the electrolyte supplied to the outer edge of the wafer 120 and the wafer chuck 110 through the nozzles 142 should be controlled and cannot be large, avoiding the electrolyte dropping from the wafer 120 and the wafer chuck 110 to form a circuit with the electrolyte providing to the main nozzle apparatus 150.

In another embodiment of the present invention, the supplying pipe of the auxiliary nozzle apparatus is made of acid resistant conductive metal and can be used as a secondary electrode. During the plating process, the supplying pipe is connected to the cathode of the power supply, and during the polishing process, the supplying pipe is connected to the anode of the power supply. The electrolyte supplied to cover the area from the outer edge of the wafer to the electrode of the wafer chuck through the nozzles defined on the supplying pipe is charged.

In another embodiment of the present invention, the wafer chuck has a metal ring disposed around the outer edge of the wafer. The wafer chuck can be without the electrode and the insulated ring. The supplying pipe of the auxiliary nozzle apparatus is made of acid resistant conductive metal and is used as an electrode. During the plating process, the supplying pipe is connected to the cathode of the power supply, and during the polishing process, the supplying pipe is connected to the anode of the power supply. The electrolyte supplied to cover the area from the outer edge of the wafer to the metal ring of the wafer chuck through the nozzles defined on the supplying pipe is charged.

With reference to FIGS. 11-15, another exemplary apparatus for plating and/or polishing wafer of the present invention is illustrated. The apparatus includes a wafer chuck 210 for holding and positioning a wafer 220. As same as the wafer chuck 110 shown in FIG. 1, the wafer chuck 210 has an electrode 211, a metal ring 212 and an insulated ring 213 disposed between the electrode 211 and the metal ring 212. During the plating process, the electrode 211 is connected to the cathode of a power supply, and during the polishing process, the electrode 211 is connected to the anode of the power supply. The electrode 211 and the wafer 220 can form an electric connection through electrolyte. The wafer chuck 210 also has a rotating shaft 214 disposed at the top portion thereof. The rotating shaft 214 can rotate about an axis through its center and then bring the wafer chuck 210 to rotate about its center axis. The rotating shaft 214 can be installed on a beam above the wafer chuck 210. The beam can move horizontally, which brings the wafer chuck 210 to move horizontally.

The apparatus further includes a main chamber 280, an auxiliary chamber 290, a main nozzle apparatus 250, an auxiliary nozzle apparatus 240 and a shroud 260. The main nozzle apparatus 250 is located in the main chamber 280 and the structure and function of the main nozzle apparatus 250 is as same as the main nozzle apparatus 150, which is no longer repeatedly described herein. The auxiliary nozzle apparatus 240 is located in the auxiliary chamber 290 and has an elongated tubular shaped supplying pipe 241. The supplying pipe 241 defines several small nozzles 242 arranged in several rows and columns for supplying the electrolyte to the outer edge of the wafer 220 and the wafer chuck 210. The area from the outer edge of the wafer 220 to the electrode 211 of the wafer chuck 210 can be covered by the electrolyte while plating or polishing so the electric connection between the outer edge of the wafer 220 and the electrode 211 is stable. The supplying pipe 241 can be connected with an independent plumbing system, so the flow of the electrolyte in the supplying pipe 241 can be controlled independently. A partition wall 270 is disposed between the main chamber 280 and the auxiliary chamber 290, making the main chamber 280 and the auxiliary chamber 290 be two independent chambers. The electrolyte in the main chamber 280 cannot enter the auxiliary chamber 290, and vice versa.

The shroud 260 includes a circle portion 261 and a rectangle portion 262. The circle portion 261 is disposed in the main chamber 280 and encircles the main nozzle apparatus 250. The rectangle portion 262 is disposed in the auxiliary chamber 290 and shields the auxiliary nozzle apparatus 240. The center of the rectangle portion 262 defines an eject window 263 from where the electrolyte is ejected to the outer edge of the wafer 220 and the wafer chuck 210. Adjacent to the eject window 263, the rectangle portion 262 defines an elongated slot 264. The rectangle portion 262 has a side wall 265 which stretches upward to form a first concave portion 266 at the top of the rectangle portion 262. The first concave portion 266 can be used for collecting the electrolyte ejected out from the auxiliary nozzle apparatus 240 and dripping from the outer edge of the wafer 220 and the wafer chuck 210. The electrolyte in the first concave portion 266 flows back to the auxiliary chamber 290 from the slot 264 for cycle use. The side wall 265 stretches downward to form a second concave portion 267 at the bottom of the rectangle portion 262. The second concave portion 267 can be used for receiving the partition wall 270 and the auxiliary nozzle apparatus 240.

When using the apparatus for plating and/or polishing the wafer 220, the wafer 220 is positioned on the wafer chuck 210 and the surface of the wafer 220 to be plated and/or polished faces to the main nozzle apparatus 250. The wafer chuck 210 moves right above the main nozzle apparatus 250. By using such as two magnetic junctions disposed on the wafer chuck 210, the shroud 260 can move along with the wafer chuck 210 during the plating and/or polishing process and separate from the wafer chuck 210 when the plating and/or polishing process is finished and the wafer chuck 210 is moved away. The wafer chuck 210 moves horizontally and at the same time rotates while the auxiliary nozzle apparatus 240 and the main nozzle apparatus 250 respectively supply the electrolyte to the surface of the wafer 220. The auxiliary nozzle apparatus 240 supplies the electrolyte to the outer edge of the wafer 220 and the wafer chuck 210 through the nozzles 242 corresponding to the eject window 263. The electrolyte covers the area from the outer edge of the wafer 220 to the electrode 211 of the wafer chuck 210 all the time during the whole plating and/or polishing process so the electric connection between the outer edge of the wafer 220 and the electrode 211 is stable, which can improve the plating and/or polishing uniformity of the outer edge of the wafer 220 and reduce the entire electric resistance of the apparatus. The electrolyte ejected from the nozzles 242 hidden under the rectangle portion 262 is blocked by the rectangle portion 262 and cannot reach the outer edge of the wafer 220. Because of the eject window 263 restriction, the eject area by the auxiliary nozzle apparatus 240 is constant, ensuring the electrolyte uniformity distribution on the area from the outer edge of the wafer 220 to the electrode 211.

The electrolyte on the outer edge of the wafer 220 and the wafer chuck 210 drops and is collected in the first concave portion 266 of the shroud 260. The electrolyte in the first concave portion 266 flows back to the auxiliary chamber 290 from the slot 264 for cycle use. The circle portion 261 of the shroud 260 can prevent the electrolyte on the wafer 220 and the wafer chuck 210 from splashing out of the main chamber 280 and the auxiliary chamber 290.

Referring to FIG. 16 to FIG. 19, another exemplary apparatus for plating and/or polishing wafer of the present invention is illustrated. The apparatus includes a wafer chuck 310 for holding and positioning a wafer 320. The wafer chuck 310 has an electrode 311, a metal ring 312, an insulated ring 313 and a rotating shaft 314.

Figure 11:
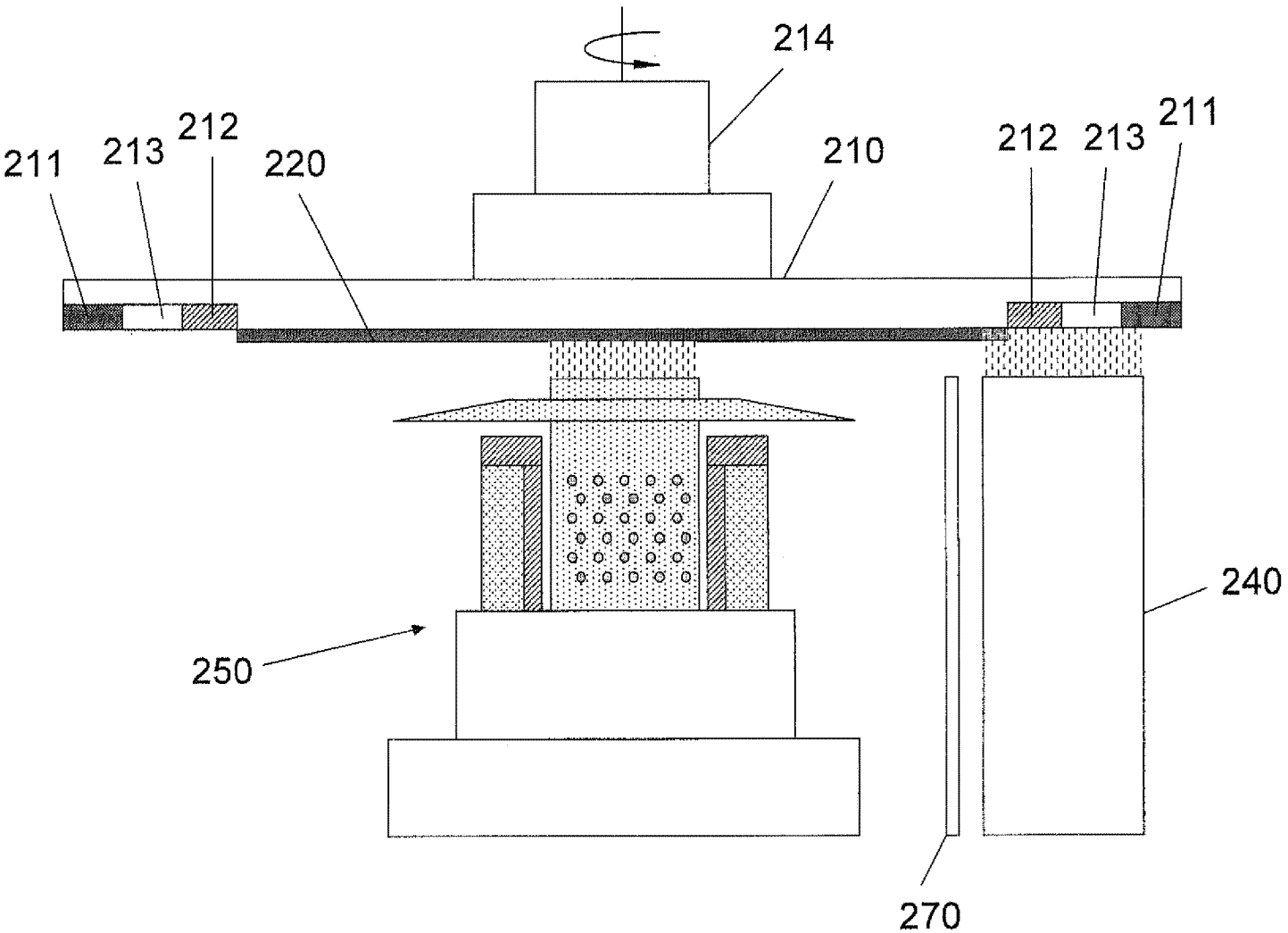
FIG. 11 is a schematic view showing another exemplary apparatus for plating and/or polishing wafer of the present invention.
Figure 12:
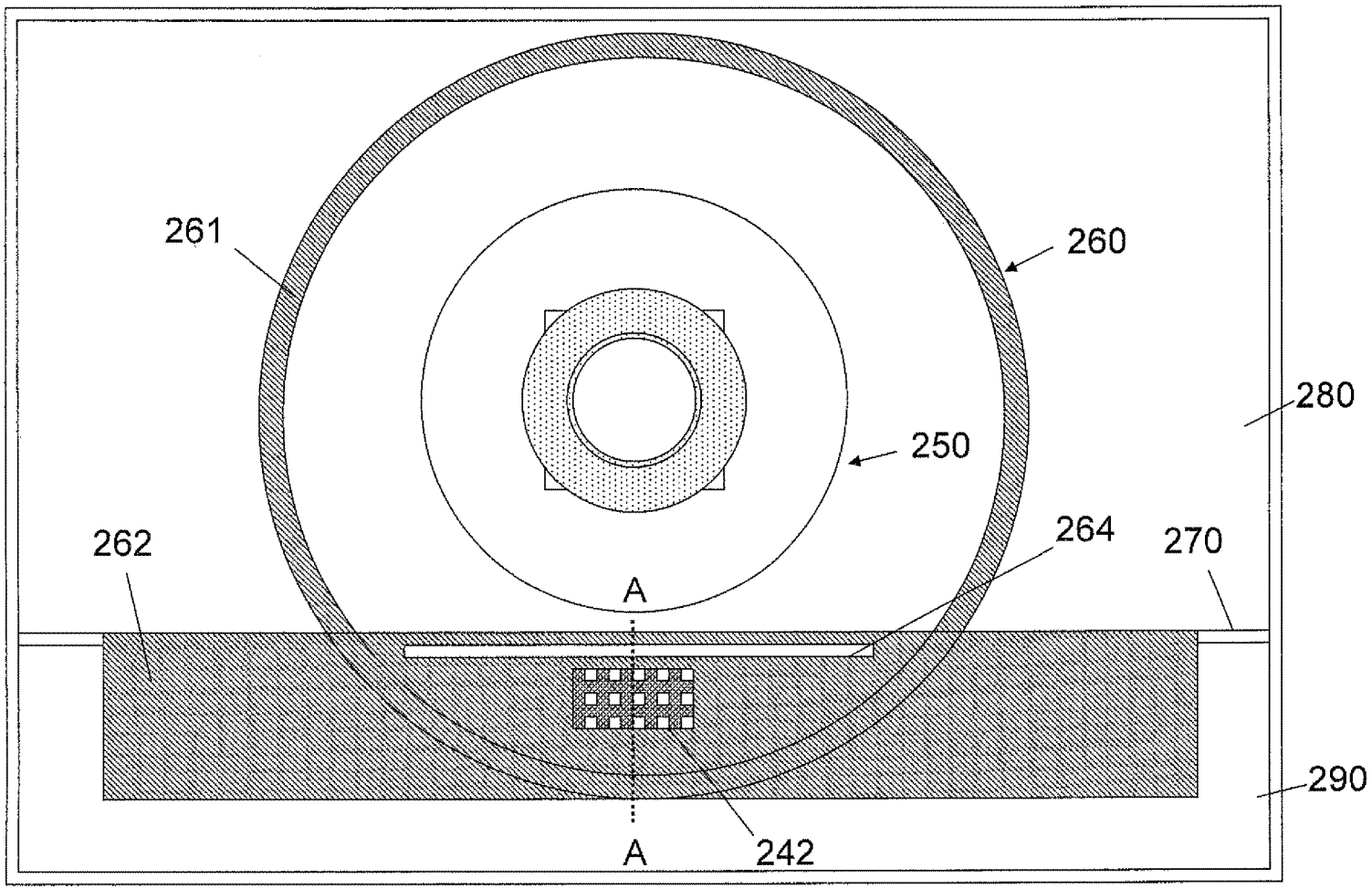
FIG. 12 is a top view of the apparatus shown in FIG. 11 without a wafer chuck.
Figure 13:
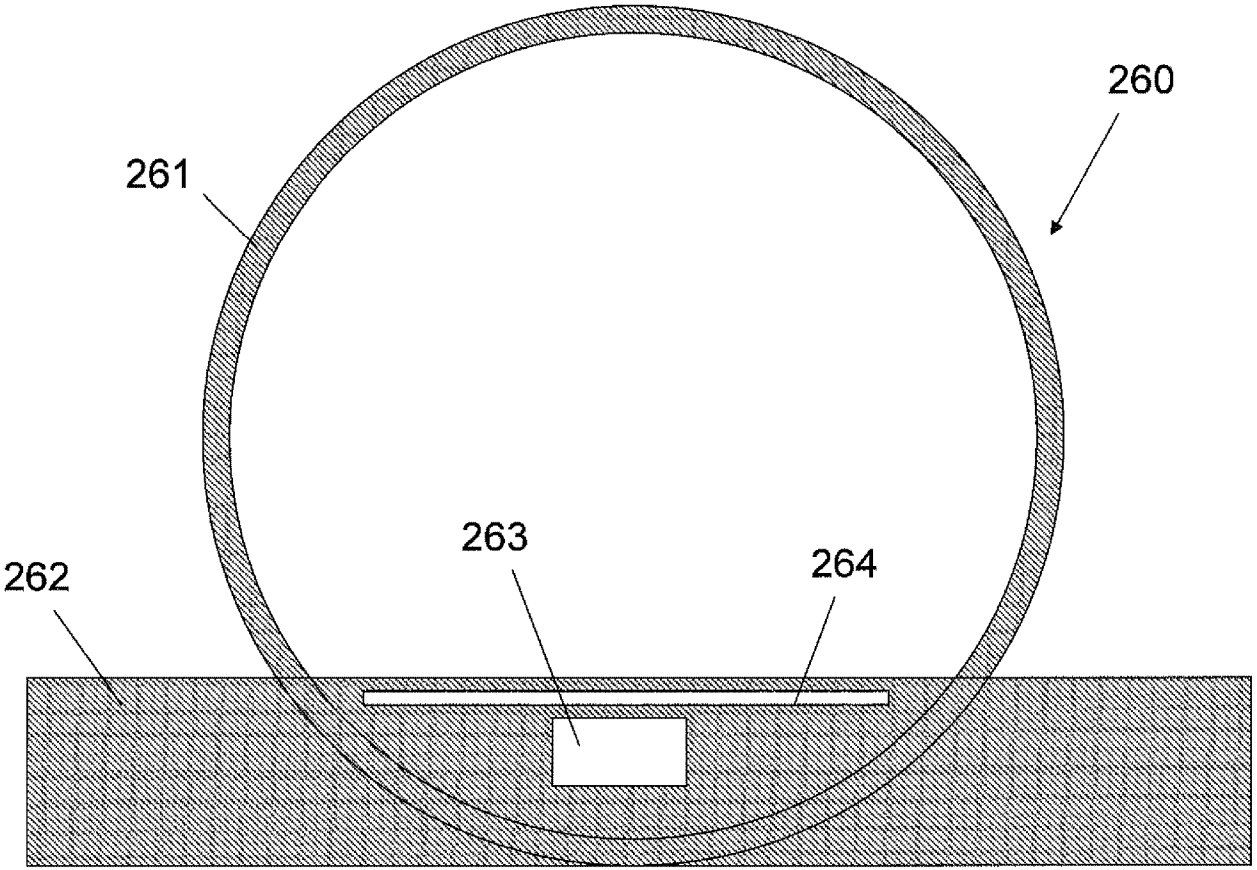
FIG. 13 is a top view of a shroud of the apparatus shown in FIG. 11.
Figure 14:
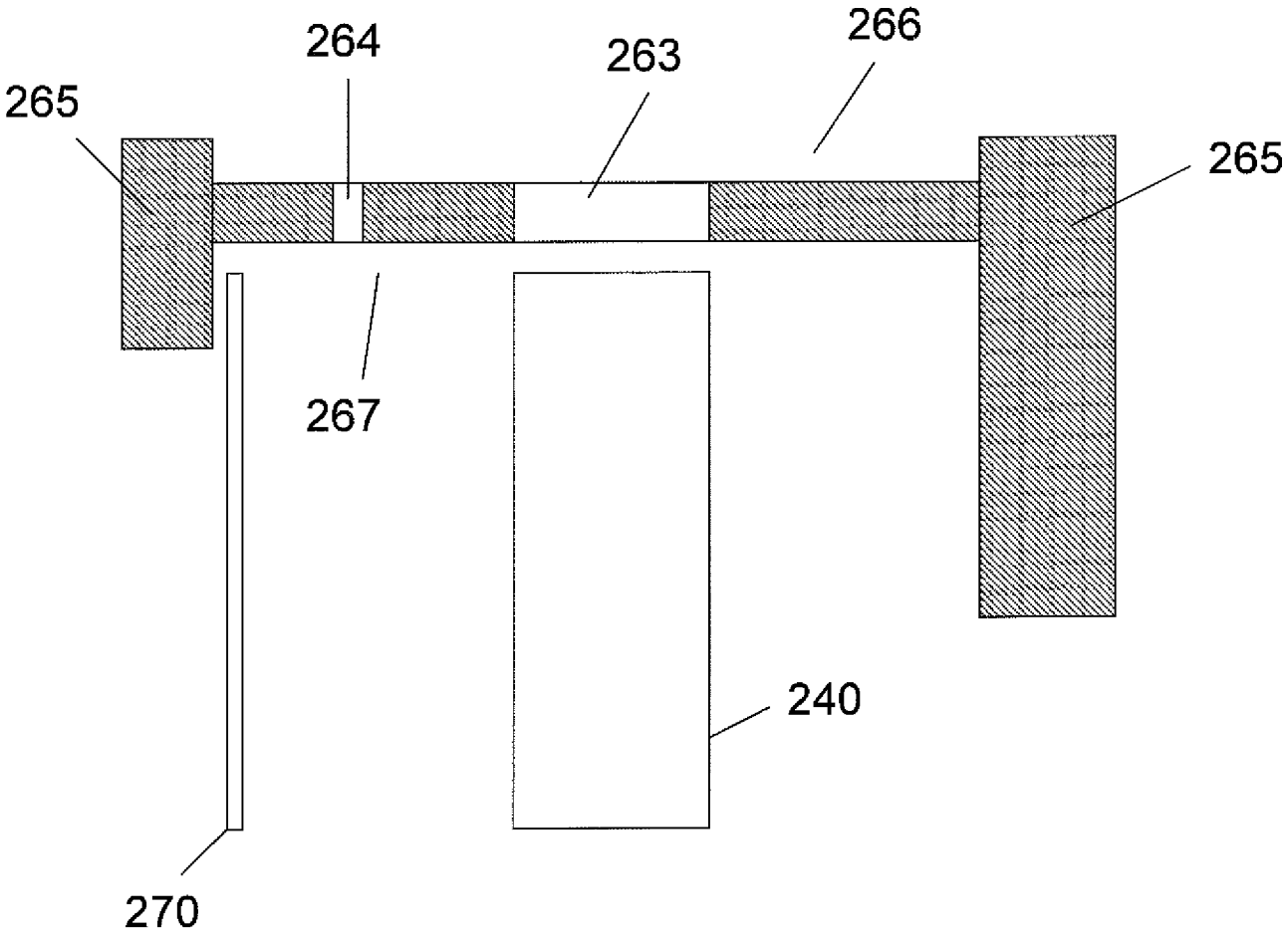
FIG. 14 is a cross-sectional view taken along line A-A shown in FIG. 12.
Figure 15:
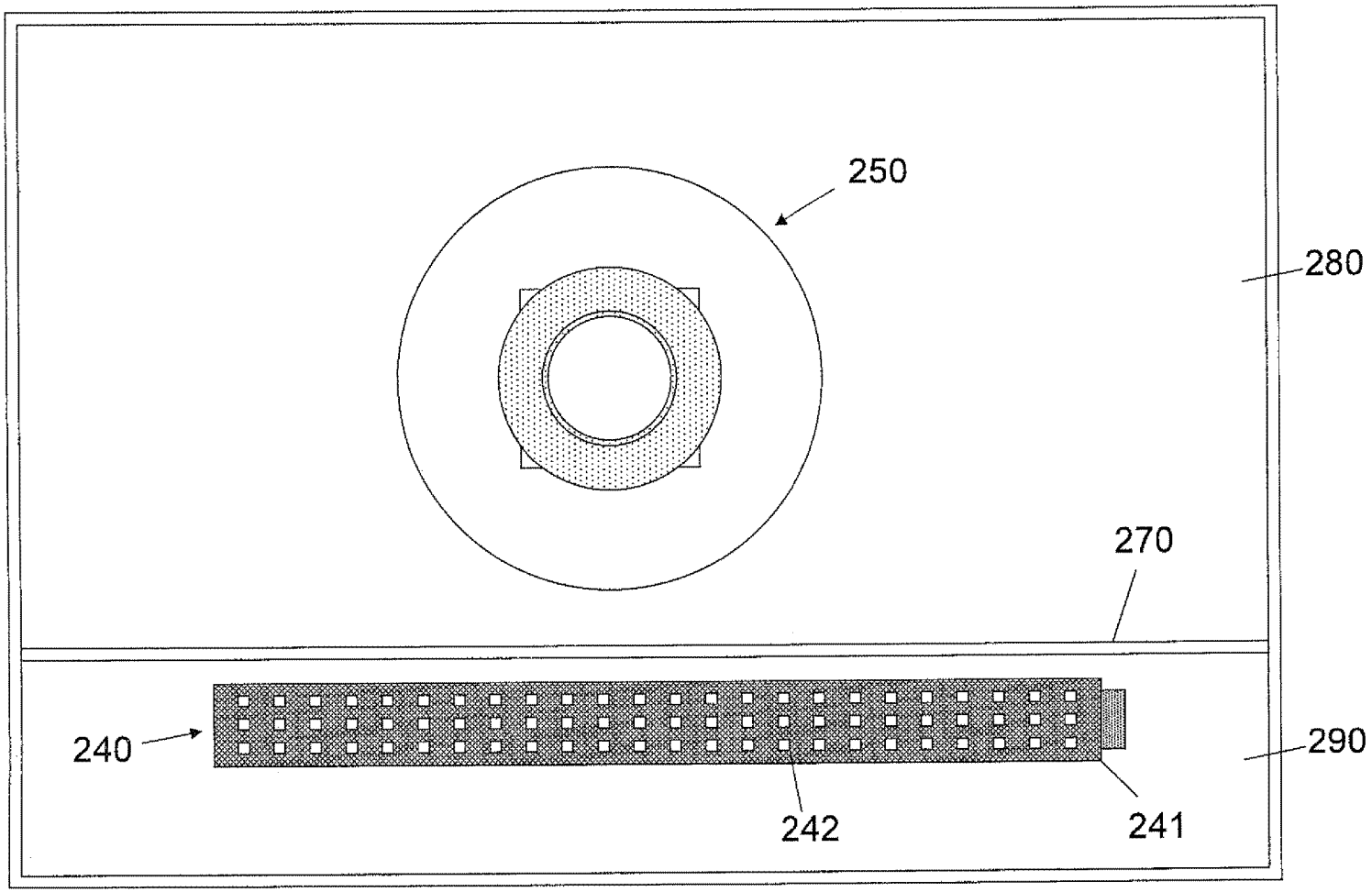
FIG. 15 is a top view of the apparatus shown in FIG. 11 without the shroud and the wafer chuck.
Figure 16:
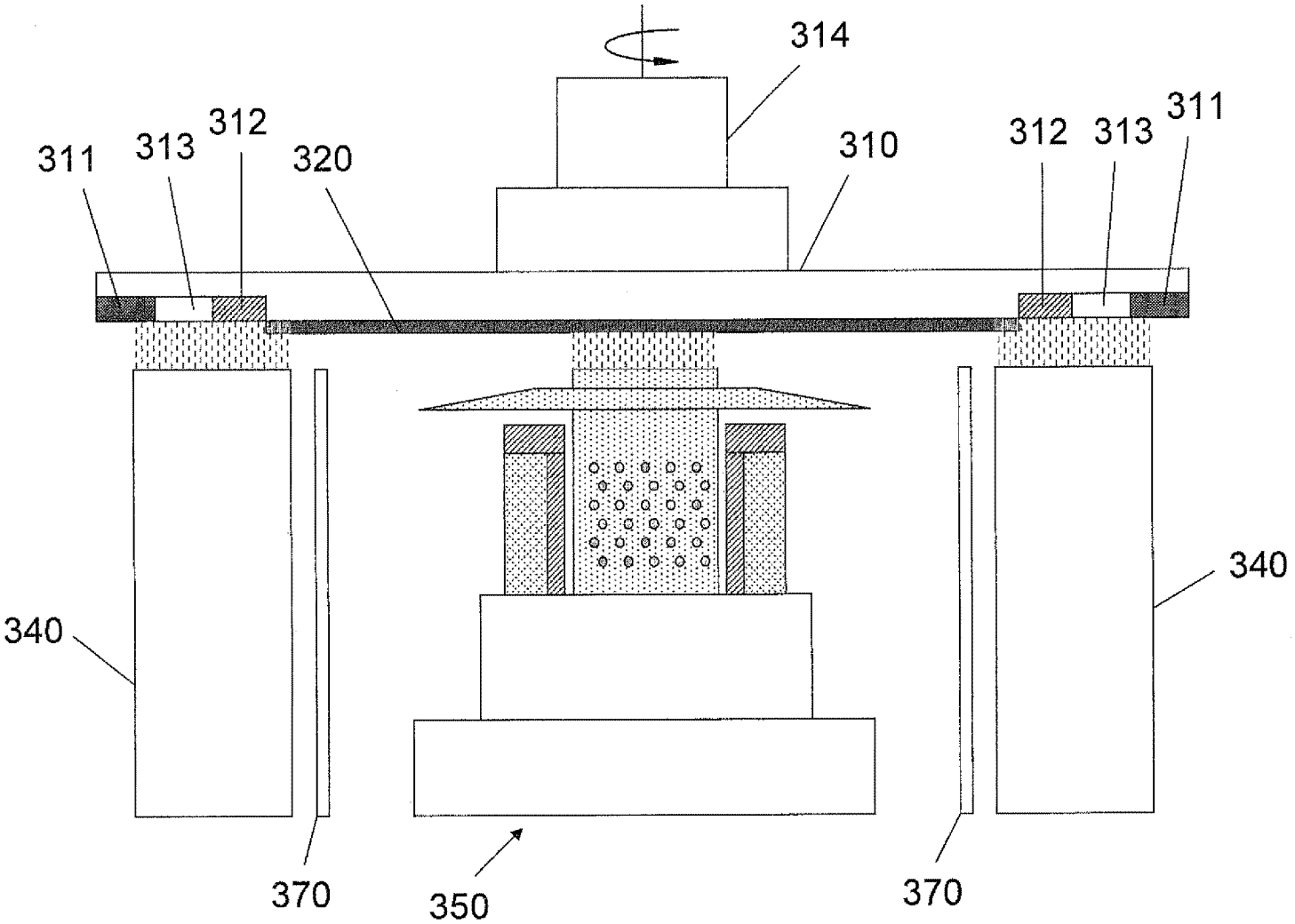
FIG. 16 is a schematic view showing another exemplary apparatus for plating and/or polishing wafer of the present invention.

Comparing to the apparatus shown in FIG. 11 and FIG. 12, the apparatus of this embodiment includes two auxiliary chambers 390 and two auxiliary nozzle apparatuses 340 respectively located in the auxiliary chambers 390. The two auxiliary chambers 390 are disposed at two opposite sides of a main chamber 380. The two auxiliary chambers 390 and the main chamber 380 are separated from each other by two partition walls 370. Each auxiliary nozzle apparatus 340 has an elongated tubular shaped supplying pipe 341. The supplying pipe 341 defines several small nozzles 342 arranged in several rows and columns for supplying the electrolyte to the outer edge of the wafer 320 and the wafer chuck 310. The area from the outer edge of the wafer 320 to the electrode 311 of the wafer chuck 310 can be covered by the electrolyte while plating or polishing so the electric connection between the outer edge of the wafer 320 and the electrode 311 is stable. A main nozzle apparatus 350 is located in the main chamber 380 for supplying the electrolyte to the surface of the wafer 320.

The apparatus further includes a shroud 360. The shroud 360 has a circle portion 361 and two rectangle portions 362 symmetric distributed at opposite sides of the circle portion 361. Each rectangle portion 362 defines an eject window 363 and an elongated slot 364.

Figure 17:
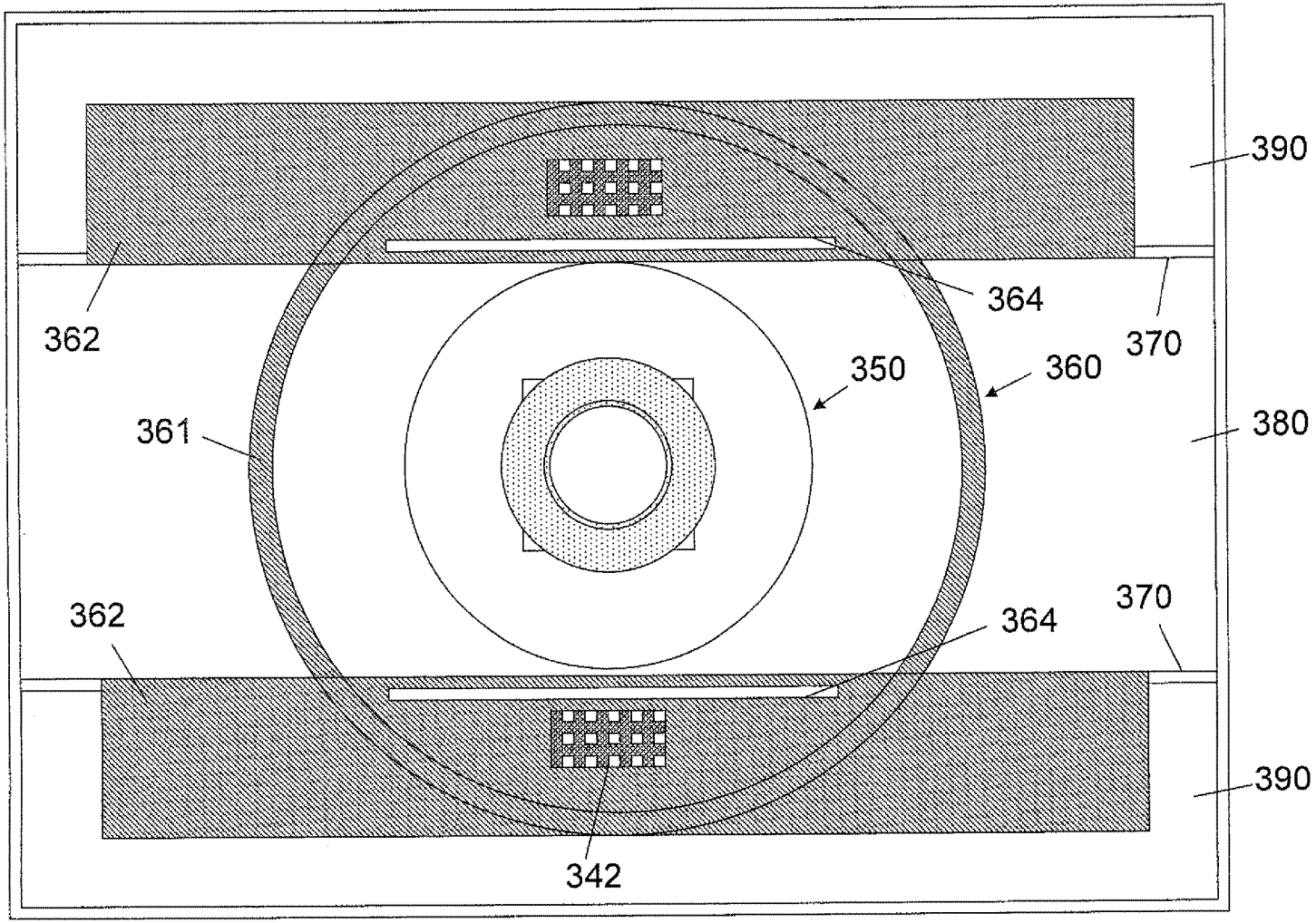
FIG. 17 is a top view of the apparatus shown in FIG. 16 without a wafer chuck.
Figure 18:
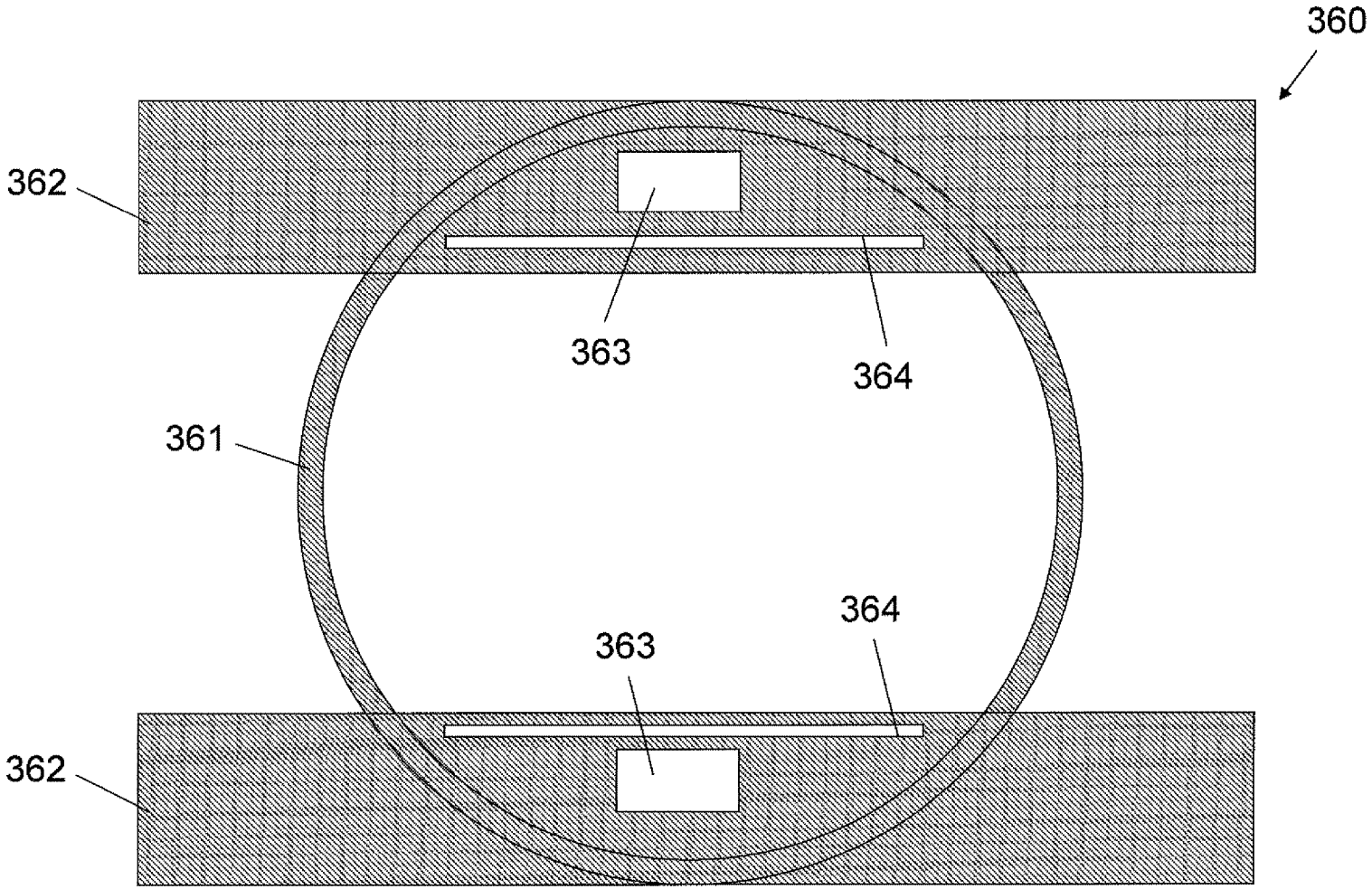
FIG. 18 is a top view of a shroud of the apparatus shown in FIG. 16.
Figure 19:
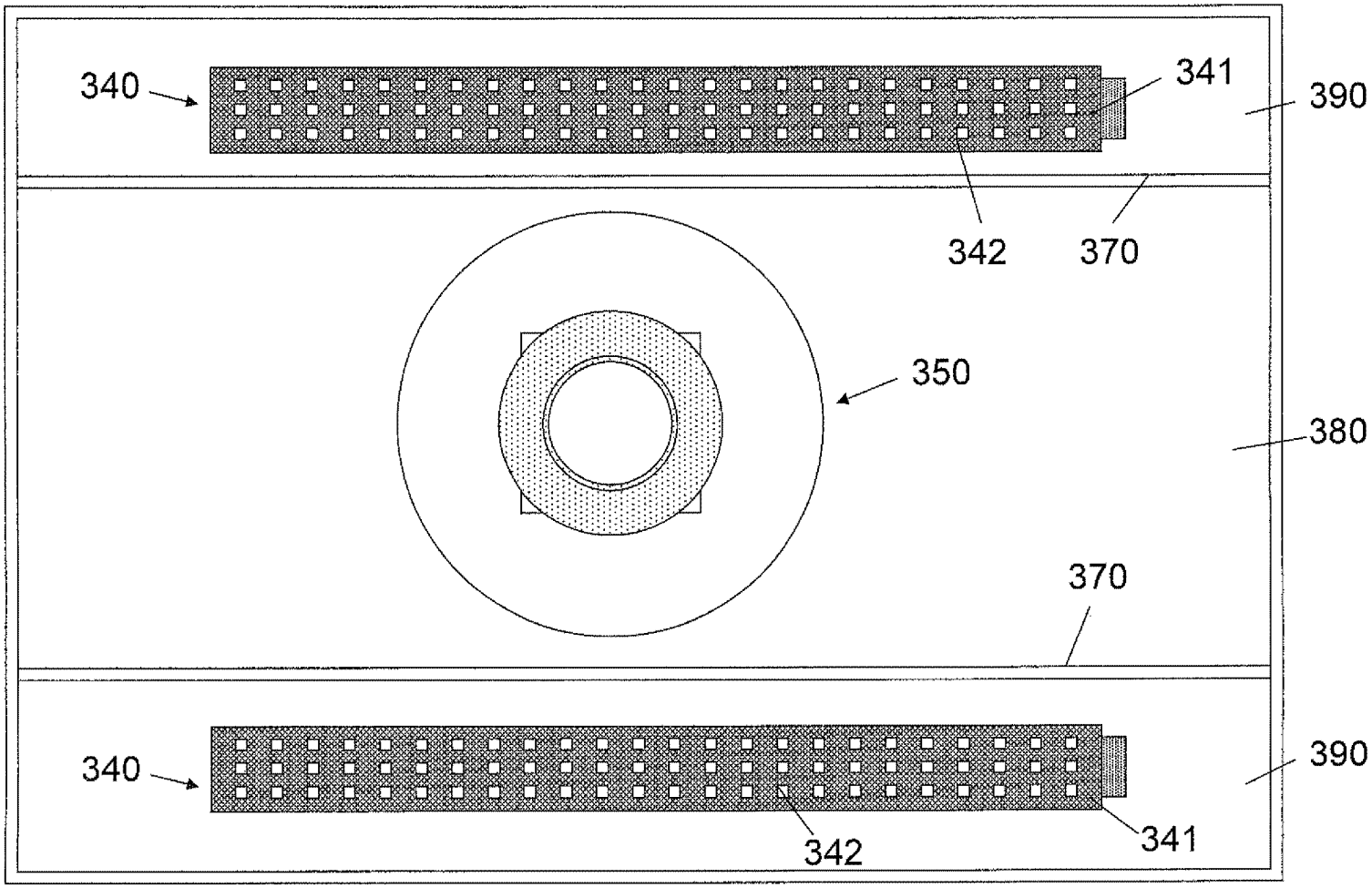
FIG. 19 is a top view of the apparatus shown in FIG. 16 without the shroud and the wafer chuck.

The difference between the apparatus shown in FIG. 12 and the apparatus shown in FIG. 17 is that the latter has a secondary auxiliary nozzle apparatus 340, a secondary auxiliary chamber 390 and a secondary rectangle portion 362, which can improve the efficiency and quality of the plating and/or polishing.

Figure 20:
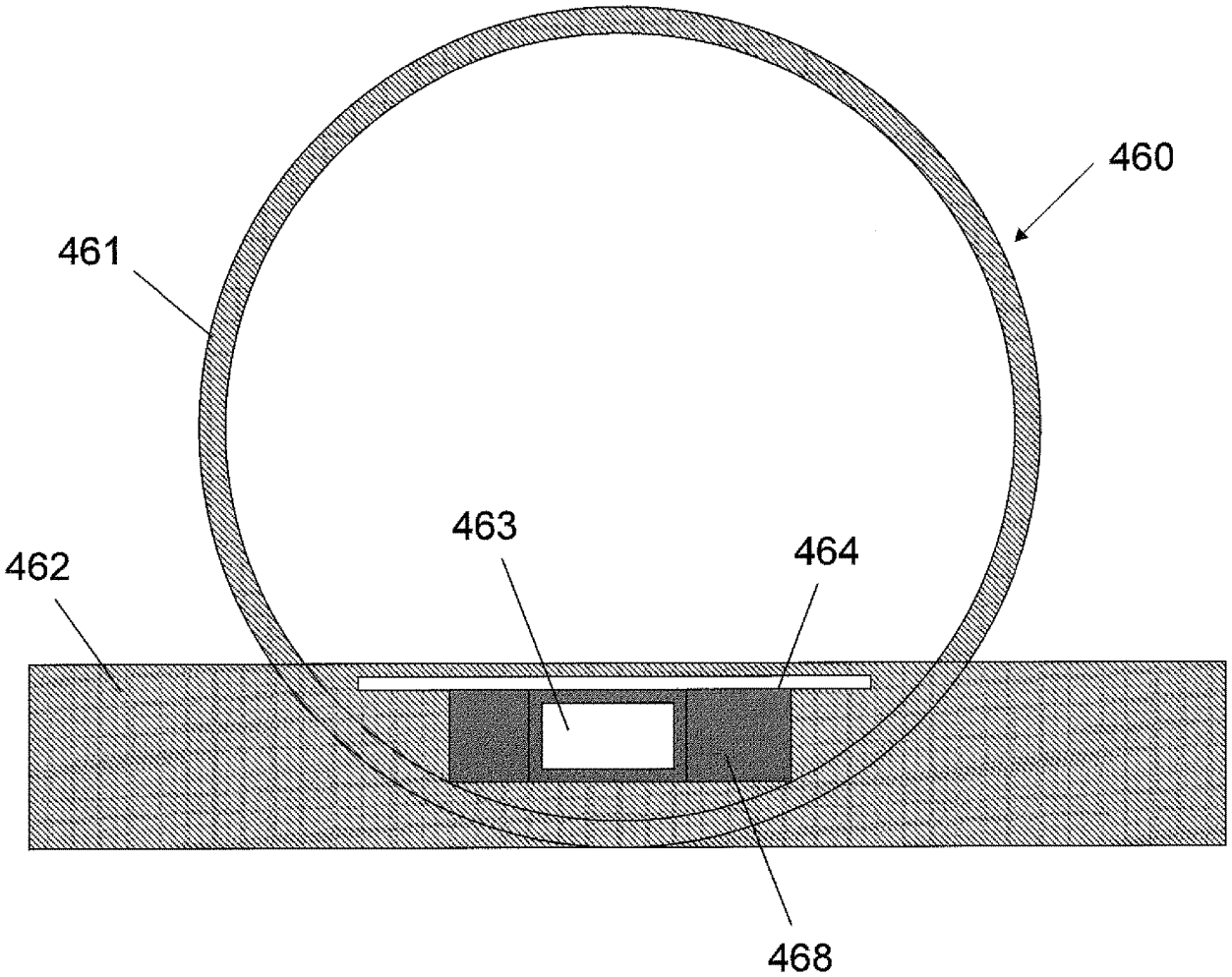
FIG. 20 is a top view of a shroud of another exemplary apparatus for plating and/or polishing wafer of the present invention.

Please refer to FIG. 20 showing a top view of a shroud of another exemplary apparatus for plating and/or polishing wafer of the present invention. The shroud 460 includes a circle portion 461 and a rectangle portion 462. The center of the rectangle portion 462 defines an eject window 463 from where the electrolyte is ejected to the outer edge of the wafer and the wafer chuck. Adjacent to the eject window 463, the rectangle portion 462 defines an elongated slot 464. Comparing to the shroud 260 shown in FIG. 13, the shroud 460 further includes an acid resistant conductive metal 468 wrapping the eject window 463. The conductive metal 468 can be used as a secondary electrode for charging the electrolyte when the electrolyte is ejected from the eject window 463. The charged electrolyte is supplied to cover the area from the outer edge of the wafer to the electrode of the wafer chuck all the time during the whole plating and/or polishing process. During the plating process, the conductive metal 468 is connected to the cathode of the power supply, and during the polishing process, the conductive metal 468 is connected to the anode of the power supply.

Figure 21:
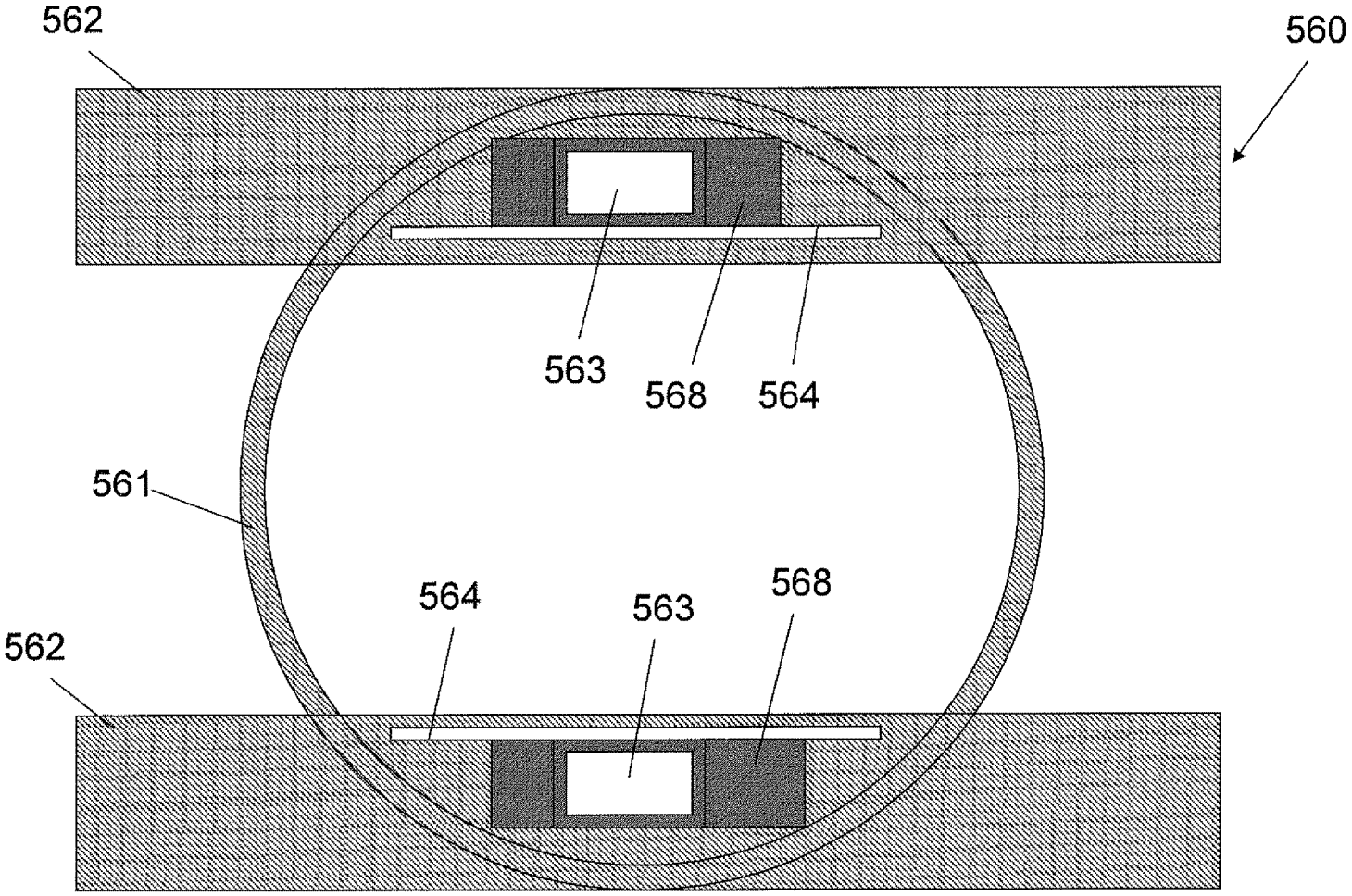
FIG. 21 is a top view of a shroud of another exemplary apparatus for plating and/or polishing wafer of the present invention.

Please refer to FIG. 21 showing a top view of a shroud of another exemplary apparatus for plating and/or polishing wafer of the present invention. The shroud 560 includes a circle portion 561 and two rectangle portions 562. The center of each rectangle portion 562 defines an eject window 563 from where the electrolyte is ejected to the outer edge of the wafer and the wafer chuck. Adjacent to the eject window 563, each rectangle portion 562 defines an elongated slot 564. Comparing to the shroud 360 shown in FIG. 18, the shroud 560 further includes two acid resistant conductive metals 568 wrapping the eject windows 563. The two conductive metals 568 can be used as secondary electrodes for charging the electrolyte when the electrolyte is ejected from the eject windows 563. The charged electrolyte is supplied to cover the area from the outer edge of the wafer to the electrode of the wafer chuck all the time during the whole plating and/or polishing process. During the plating process, the conductive metals 568 are connected to the cathode of the power supply, and during the polishing process, the conductive metals 568 are connected to the anode of the power supply.

In another embodiment of the present invention, if the shroud 460/560 includes the conductive metal 468/568 used as an electrode, the wafer chuck can be without the electrode and the insulated ring.

Accordingly, a method for plating and/or polishing a wafer includes the following steps:

Step 1: positioning the wafer on a wafer chuck;

Step 2: horizontally moving and rotating the wafer chuck; and

Step 3: supplying charged electrolyte to the surface of the wafer, and at the same time supplying uncharged electrolyte to cover the outer edge of the wafer and the wafer chuck for forming a breakover between the outer edge of the wafer and a power supply.

Accordingly, another method for plating and/or polishing a wafer includes the following steps:

Step 1: positioning the wafer on a wafer chuck;

Step 2: horizontally moving and rotating the wafer chuck; and

Step 3: supplying charged electrolyte to the surface of the wafer, and at the same time supplying charged electrolyte to cover the outer edge of the wafer and the wafer chuck for forming a breakover between the outer edge of the wafer and a power supply.

As described above, through supplying the uncharged or charged electrolyte to cover the outer edge of the wafer and the wafer chuck for forming a breakover between the outer edge of the wafer and the power supply all the time during the whole plating and/or polishing process, the outer edge of the wafer and the power supply can form a stable electric connection, which can improve the plating and/or polishing uniformity of the outer edge of the wafer and reduce the entire electric resistance of the apparatus. Moreover, the ejecting port of the main nozzle apparatus is relatively large to improve the plating and/or polishing rate.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An apparatus for plating and/or polishing a wafer, comprising:

a wafer chuck capable of moving horizontally and rotating and for holding and positioning the wafer, wherein the wafer chuck has an electrode, a metal ring encircling an outer edge of the wafer and an insulated ring disposed between the electrode and the metal ring;

an auxiliary nozzle apparatus having a supplying pipe, wherein the supplying pipe has several nozzles for supplying an electrolyte solution to cover an area from the outer edge of the wafer to the electrode of the wafer chuck; and a main nozzle apparatus having a conductive body and an insulated nozzle head, wherein the conductive body has a fixing portion and a receiving portion, and the insulated nozzle head has a cover and a tube, wherein the tube is received in the receiving portion and passes through the receiving portion for supplying the electrolyte solution to a surface of the wafer, wherein a first gap is formed between an inner circumferential surface of the receiving portion and an outer circumferential surface of the tube, wherein the cover is disposed above the fixing portion and a second gap is formed between the cover and the fixing portion.

2. The apparatus according to claim 1, wherein the tube has a plurality of passages on a side wall thereof, wherein every passage is inclined and the highest point of the internal port of the passage is at a position lower than the lowest point of the external port of the passage.

3. The apparatus according to claim 1, further comprising a flow adjust ring disposed at the lower end of the tube and attached to an outer circumferential surface of the tube for adjusting a pressure of the electrolyte solution in the first gap.

4. The apparatus according to claim 1, wherein the supplying pipe of the auxiliary nozzle apparatus is connected with an independent plumbing system for independently controlling a flow of the electrolyte solution in the supplying pipe.

5. The apparatus according to claim 1, wherein the auxiliary nozzle apparatus is rotatable in a horizontal plane, and during a plating and/or polishing process, the supplying pipe is below the wafer chuck such that the several nozzles face the outer edge of the wafer and wafer chuck.

6. The apparatus according to claim 5, wherein after the plating and/or polishing process, the auxiliary nozzle apparatus rotates 90 degrees in the horizontal plane to stop supplying the electrolyte solution to the outer edge of the wafer and the wafer chuck.

7. The apparatus according to claim 1, further comprising a beam capable of moving horizontally and disposed above the wafer chuck, wherein the wafer chuck has a rotating shaft installed on the beam and the rotating shaft allows the wafer chuck to rotate about its center axis.

8. The apparatus according to claim 1, wherein the main nozzle apparatus has a hollow holding portion, the fixing portion of the conductive body is fixed on the top of the hollow holding portion and the receiving portion of the conductive body is received in the hollow holding portion.

9. The apparatus according to claim 1, wherein the wafer chuck is a vacuum chuck.

10. The apparatus according to claim 1, wherein the supplying pipe of the auxiliary nozzle apparatus is made of a conductive metal and is used as a secondary electrode.

11. An apparatus for plating and/or polishing a wafer, comprising:

a wafer chuck capable of moving horizontally and rotating and for holding and positioning the wafer;

an auxiliary nozzle apparatus having a supplying pipe made of a conductive metal and being used as an electrode, wherein the supplying pipe has several nozzles for supplying an electrolyte solution to cover an outer edge of the wafer; and a main nozzle apparatus having a conductive body and an insulated nozzle head, wherein the conductive body has a fixing portion and a receiving portion, and the insulated nozzle head having a cover and a tube, wherein the tube is received in the receiving portion and passes through the receiving portion for supplying the electrolyte solution to a surface of the wafer, wherein a first gap is formed between an inner circumferential surface of the receiving portion and an outer circumferential surface of the tube, wherein the cover is disposed above the fixing portion and a second gap is formed between the cover and the fixing portion.

12. The apparatus according to claim 11, wherein the wafer chuck has a metal ring encircling the outer edge of the wafer, and the auxiliary nozzle apparatus supplies the electrolyte solution to cover an area from the outer edge of the wafer to the metal ring of the wafer chuck.

13. The apparatus according to claim 1, further comprising:

a main chamber, wherein the main nozzle apparatus is located in the main chamber;

an auxiliary chamber separated from the main chamber, wherein the auxiliary nozzle apparatus is located in the auxiliary chamber; and a shroud including a circle portion and a rectangle portion, wherein the circle portion is disposed in the main chamber and encircling the main nozzle apparatus, and the rectangle portion is disposed in the auxiliary chamber and shields the auxiliary nozzle apparatus, wherein the rectangle portion defines an eject window from where the electrolyte solution is ejected to cover the area from the outer edge of the wafer to the electrode of the wafer chuck.

14. The apparatus according to claim 13, wherein the main chamber and the auxiliary chamber are separated from each other by a partition wall.

15. The apparatus according to claim 13, wherein the shroud further includes a conductive metal wrapping the eject window, and the conductive metal is used as a secondary electrode for charging the electrolyte solution when the electrolyte solution is ejected from the eject window.

16. The apparatus according to claim 13, further comprising a secondary auxiliary chamber and a secondary auxiliary nozzle apparatus located in the secondary auxiliary chamber, and the shroud further comprises a secondary rectangle portion, wherein the secondary rectangle portion is disposed in the secondary auxiliary chamber and shields the secondary auxiliary nozzle apparatus, wherein the secondary rectangle portion defines a second eject window from where the electrolyte solution is ejected to cover the area from the outer edge of the wafer to the electrode of the wafer chuck.

17. The apparatus according to claim 16, wherein the two auxiliary chambers are disposed at two opposite sides of the main chamber and separated from the main chamber by partition walls.

18. The apparatus according to claim 16, wherein the shroud further includes a secondary conductive metal wrapping the second eject window defined on the secondary rectangle portion, the secondary conductive metal is used as a secondary electrode for charging the electrolyte solution when the electrolyte solution is ejected from the second eject window of the secondary rectangle portion.

19. An apparatus for plating and/or polishing a wafer, comprising:

a wafer chuck capable of moving horizontally and rotating and for holding and positioning the wafer;

a main chamber;

an auxiliary chamber separated from the main chamber;

an auxiliary nozzle apparatus located in the auxiliary chamber and having a supplying pipe, the supplying pipe has several nozzles;

a main nozzle apparatus located in the main chamber and having a conductive body and an insulated nozzle head, wherein the conductive body has a fixing portion and a receiving portion, and the insulated nozzle head has a cover and a tube, wherein the tube is received in the receiving portion and passes through the receiving portion for supplying an electrolyte solution to a surface of the wafer, wherein a first gap is formed between an inner circumferential surface of the receiving portion and an outer circumferential surface of the tube, wherein the cover is disposed above the fixing portion and a second gap is formed between the cover and the fixing portion; and a shroud including a circle portion and a rectangle portion, wherein the circle portion is disposed in the main chamber and encircling the main nozzle apparatus, and the rectangle portion is disposed in the auxiliary chamber and shielding the auxiliary nozzle apparatus, wherein the rectangle portion defining an eject window from where the electrolyte solution is ejected to cover the outer edge of the wafer, wherein a conductive metal wraps around the eject window, wherein the conductive metal is used as an electrode for charging the electrolyte solution when the electrolyte solution is ejected from the eject window.

20. The apparatus as claimed in claim 19, wherein the wafer chuck has a metal ring encircling the outer edge of the wafer, the electrolyte solution is ejected to cover an area from the outer edge of the wafer to the metal ring of the wafer chuck.

21. The apparatus as claimed in claim 19, further comprising a secondary auxiliary chamber and a secondary auxiliary nozzle apparatus located in the secondary auxiliary chamber, wherein the shroud further includes a secondary rectangle portion, wherein the secondary rectangle portion is disposed in the secondary auxiliary chamber and shields the secondary auxiliary nozzle apparatus, wherein the secondary rectangle portion defines a second eject window from where the electrolyte solution is ejected to cover the outer edge of the wafer, wherein a secondary conductive metal wraps around the second eject window defined on the secondary rectangle portion, wherein the secondary conductive metal is used as an electrode for charging the electrolyte solution when the electrolyte solution is ejected from the second eject window of the secondary rectangle portion.

* * * * *